US007634217B2

(12) United States Patent
Tamura et al.

(10) Patent No.: US 7,634,217 B2
(45) Date of Patent: Dec. 15, 2009

(54) ELECTROPHOTOGRAPHIC IMAGE FORMING METHOD USING A DOUBLE WALLED TONER CARTRIDGE

(75) Inventors: Kishio Tamura, Tokyo (JP); Ken Ohmura, Tokyo (JP); Tomomi Oshiba, Tokyo (JP); Sayuri Nakano, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 265 days.

(21) Appl. No.: 11/680,005

(22) Filed: Feb. 28, 2007

(65) Prior Publication Data

US 2007/0274743 A1 Nov. 29, 2007

(30) Foreign Application Priority Data

May 4, 2006 (JP) ..... 2006-143695

(51) Int. Cl.
*G03G 15/08* (2006.01)

(52) U.S. Cl. ..... 399/258

(58) Field of Classification Search ..... 399/258, 399/260, 262

See application file for complete search history.

(56) References Cited

U.S. PATENT DOCUMENTS 4,584,822 A * 4/1986 Fielding et al. ..... 53/452
5,131,539 A * 7/1992 Karita et al. ..... 206/462
5,871,097 A * 2/1999 Shida et al. ..... 206/521
6,450,631 B1 * 9/2002 Hayashi et al. ..... 347/86
2006/0157882 A1 * 7/2006 Percec et al. ..... 264/48
2007/0177904 A1 * 8/2007 Arai ..... 399/262
2007/0201906 A1 * 8/2007 Tamura et al. ..... 399/262

FOREIGN PATENT DOCUMENTS

JP 61138970 A * 6/1986
JP 05341647 A * 12/1993
JP 2000060313 A * 2/2000
JP 2001066831 A * 3/2001

* cited by examiner

*Primary Examiner*—Quana M Grainger
(74) *Attorney, Agent, or Firm*—Lucas & Mercanti, LLP

(57) ABSTRACT

An image forming method wherein a storage container, accommodating the toner having a volume-based median diameter of 3.5 μm through 8.5 μm and containing a resin having a glass-transition temperature of 0° C. through 46° C. and a softening point of 75° C. through 110° C., is included in an packaging container made of a substance having an apparent density of 0.1 through 0.3; and a toner supply section constituting the storage container is exposed to the outside from the packaging container, and is loaded on the image forming apparatus, whereby toner is supplied to the image forming apparatus.

17 Claims, 12 Drawing Sheets

FIG. 6
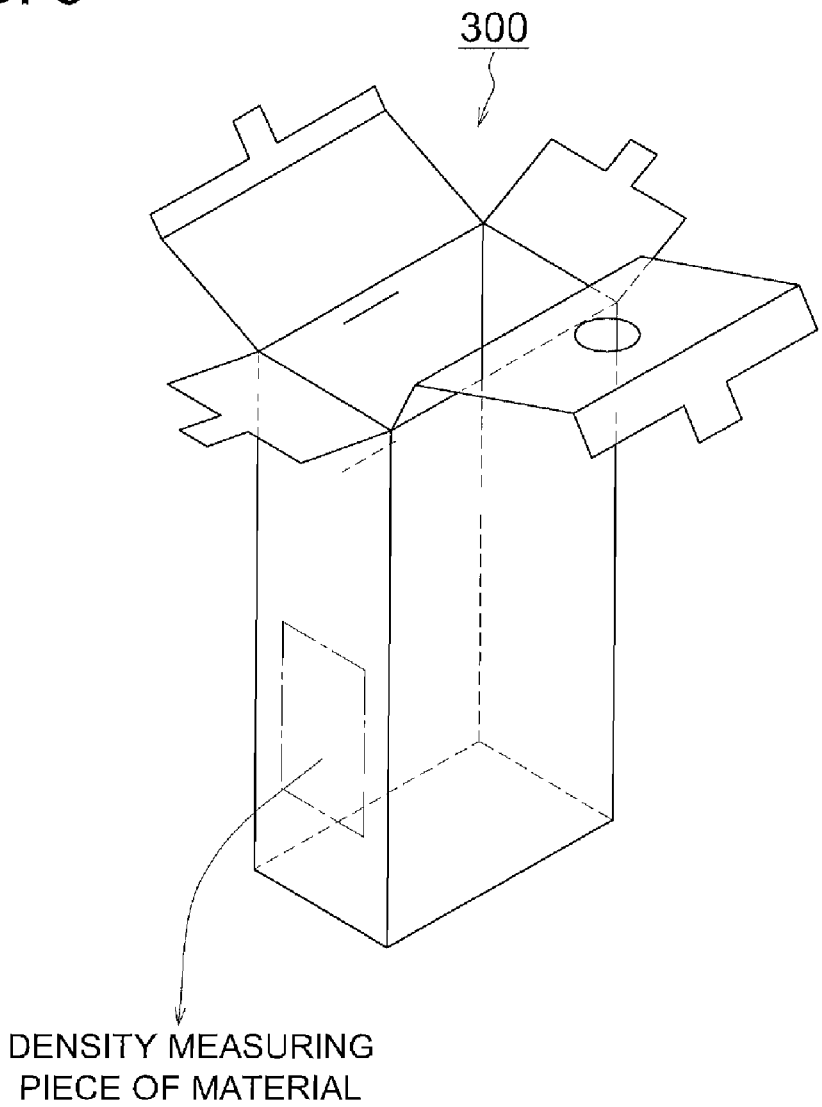
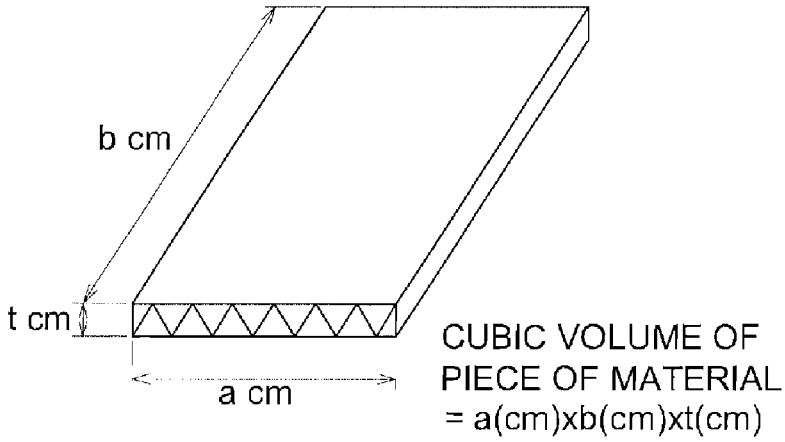

FIG. 9 ( b )
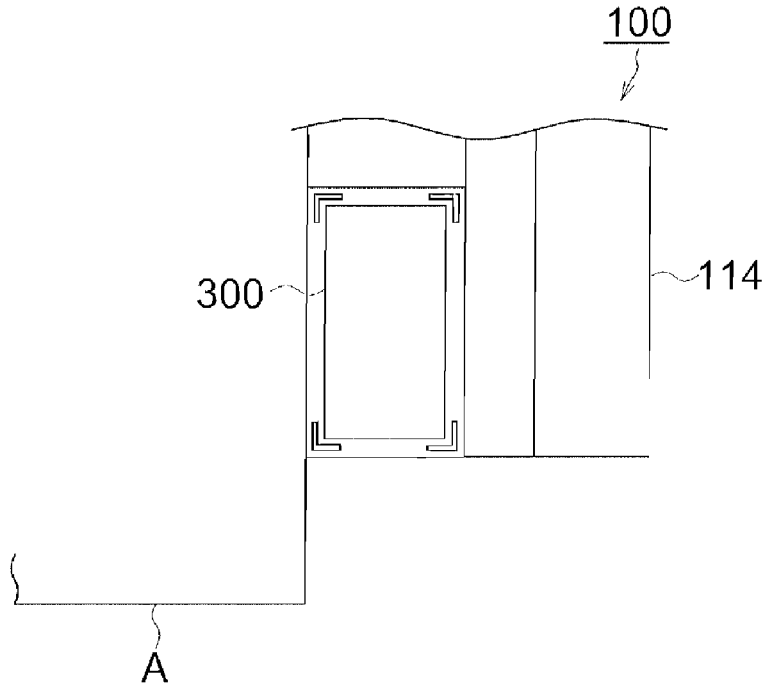
FIG. 9 ( a )
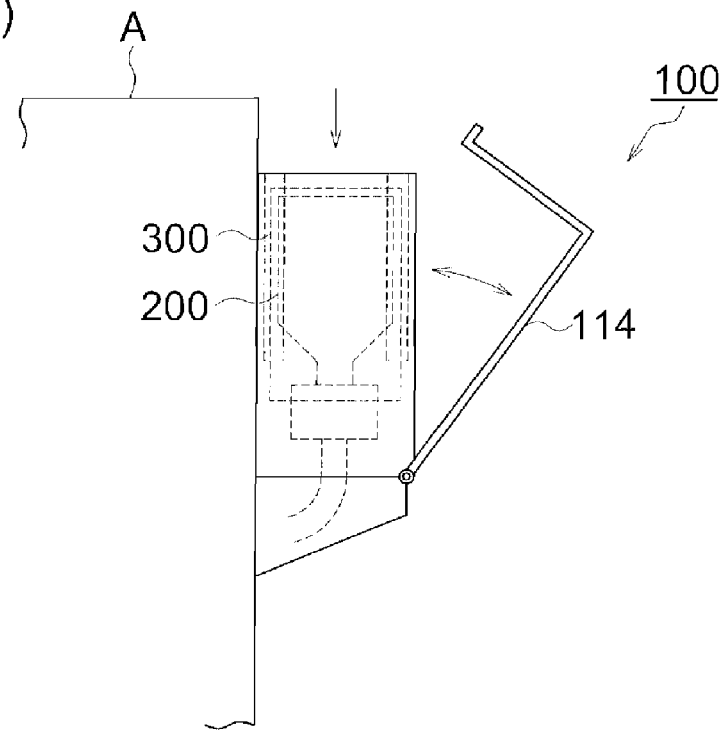

ELECTROPHOTOGRAPHIC IMAGE FORMING METHOD USING A DOUBLE WALLED TONER CARTRIDGE

CROSS-REFERENCE TO RELATED APPLICATION

The present application is based on Japanese Patent Application No. 2006-143695 filed with Japan Patent Office on May 24, 2006, entire content of which is hereby incorporated by reference.

BACKGROUND OF THE INVENTION

The present invention relates to an image forming method wherein toner is supplied to an image forming apparatus from a toner cartridge made up of a toner storage container and a packaging container for packaging a storage container.

In the field of image forming technique using an electrophotographic process in recent years, studies have been made to develop a technique for forming an image with less power consumption to give consideration to global environment. One of such techniques has succeeded in forming an image at a fixing temperature lower than the conventional temperature by utilizing a polymerized toner or the like containing the wax of lower melting point (e.g., Patent Document 1).

When storing such toner especially in a high-temperature environment, there is a concern about a problem of blocking wherein toner particles are coagulated with one another by heat. To eliminate the possibility of causing blocking during toner storage, development efforts have been made to find out a method of accommodating and storing toner in a container characterized by excellent heat insulation.

The following describes the techniques on a toner container of excellent heat insulation. One of such techniques is exemplified by the invention wherein a toner container uses an organic expandable material as either the inner shell material and outer shell material of a thin-walled synthetic resin-made supporting member or the intermediate material of two supporting members having two-layer structure (e.g., Patent Document 2). Another example is an invention of using a toner container formed of a material having heat conductivity below a predetermined value (e.g., Patent Document 3). A further example is provided an invention wherein a plurality of plastic molded products forming the heat insulating layer are employed to produce a toner container that maintains high printing accuracy in a high-temperature environment (e.g., Patent Document 4). As described above, efforts have been made to develop the techniques for maintaining the toner quality without being affected by the environment, and achieving stable preservation.

[Patent Document 1] Unexamined Japanese Patent Application Publication No. 2001-42564

[Patent Document 2] Unexamined Japanese Patent Application Publication No. H5-341647

[Patent Document 3] Unexamined Japanese Patent Application Publication No. H6-72472

[Patent Document 4] Unexamined Japanese Patent Application Publication No. 2004-13085

The main stream in the image forming apparatus based on electrophotographic technology has been the technique wherein a toner-containing cartridge is mounted on an apparatus and toner is supplied from the mounted cartridge. The containers disclosed in the aforementioned Patent Documents 2 and 3 are intended to store and convey toner, but these documents fail to describe use of the container itself as a cartridge being mounted on the main body of the image forming apparatus. Further, the Patent Document 4 discloses a toner container used as a cartridge. In this technique, however, much time and effort have been required to manufacture a cartridge. For example, in order to form a resin layer constituting the cartridge and a heat insulating layer, a great number of molding operations has to be performed to form a sandwich structure.

SUMMARY OF THE INVENTION

An object of the present invention is to provide an image forming method that can ensure stable image formation with toner characterized by low-temperature fixing property, by using a toner cartridge that can be manufactured in a simple process and can be stored and conveyed without the stored toner being affected by fluctuation of outside air.

Another object of the present invention is to provide an environment-friendly and user-friendly image forming method by using a toner cartridge capable of ensuring that the burden resulting from generation of waste or utilization is not imposed on a user.

One aspect of the invention can be an image forming method wherein toner is supplied to an image forming apparatus loaded on a storage container for storing the toner that contains a resin having a glass-transition temperature of 0° C. through 46° C. and a softening point of 75° C. through 110° C., and having a volume-based median diameter (D50) of 3.5 μm through 8.5 μm; wherein this storage container is included in an packaging container made of a substance with an apparent density of 0.1 through 0.3, and is loaded on the image forming apparatus to supply toner, after a toner supply section constituting the storage container is exposed from the packaging container.

BRIEF DESCRIPTION OF THE DRAWINGS

FIG. 6 is a schematic view for manufacturing an apparent density measuring material piece from the packaging container 300.

FIG. 9 is a side view and partial plan view in the vicinity of the toner replenishment section 100.

DETAILED DESCRIPTION OF THE PREFERRED EMBODIMENT

The objects of the present invention can be achieved by utilizing a toner cartridge wherein a storage container storing toner having low-temperature fixing property is packaged in a packaging container made of a substance having a specific gravity within a predetermined range. To be more specific, the material having an apparent density within a predetermined range is selected as a material of packaging container to ensure that the toner stored in the storage container is not affected by outside air. When four-color toner products have been set especially at the time of color image forming, a subtle temperature difference occurs depending on the set position of each toner cartridge. Further, the influence of the fluctuation in humidity will take effect. Thus, there is a concern that a difference in the amount of static charge will occur among toner products of various colors. In the present invention, the cartridge including the packaging container is mounted on the image forming apparatus, thereby avoiding these problems and ensuring stable color reproduction.

As described above, the present invention improves toner storage stability by using a toner cartridge, a toner storage container and a storage container packaging container, and by giving a superb heat insulation property to the packaging container originally intended for impact absorption.

The following describes the details of embodiments related to the present invention:

In the first place, the following describes an example of embodiment of a representative toner cartridge applicable to the present invention, with reference to drawings. The toner cartridge in the sense in which it is used in the present invention refers to a toner container that includes toner and is directly mounted on the main body of the image forming apparatus to supply toner.

The assertive expression in the following description of the embodiment is based on the best mode without restricting the meaning or technological scope of the terminology used in the present invention.

Figure 1:
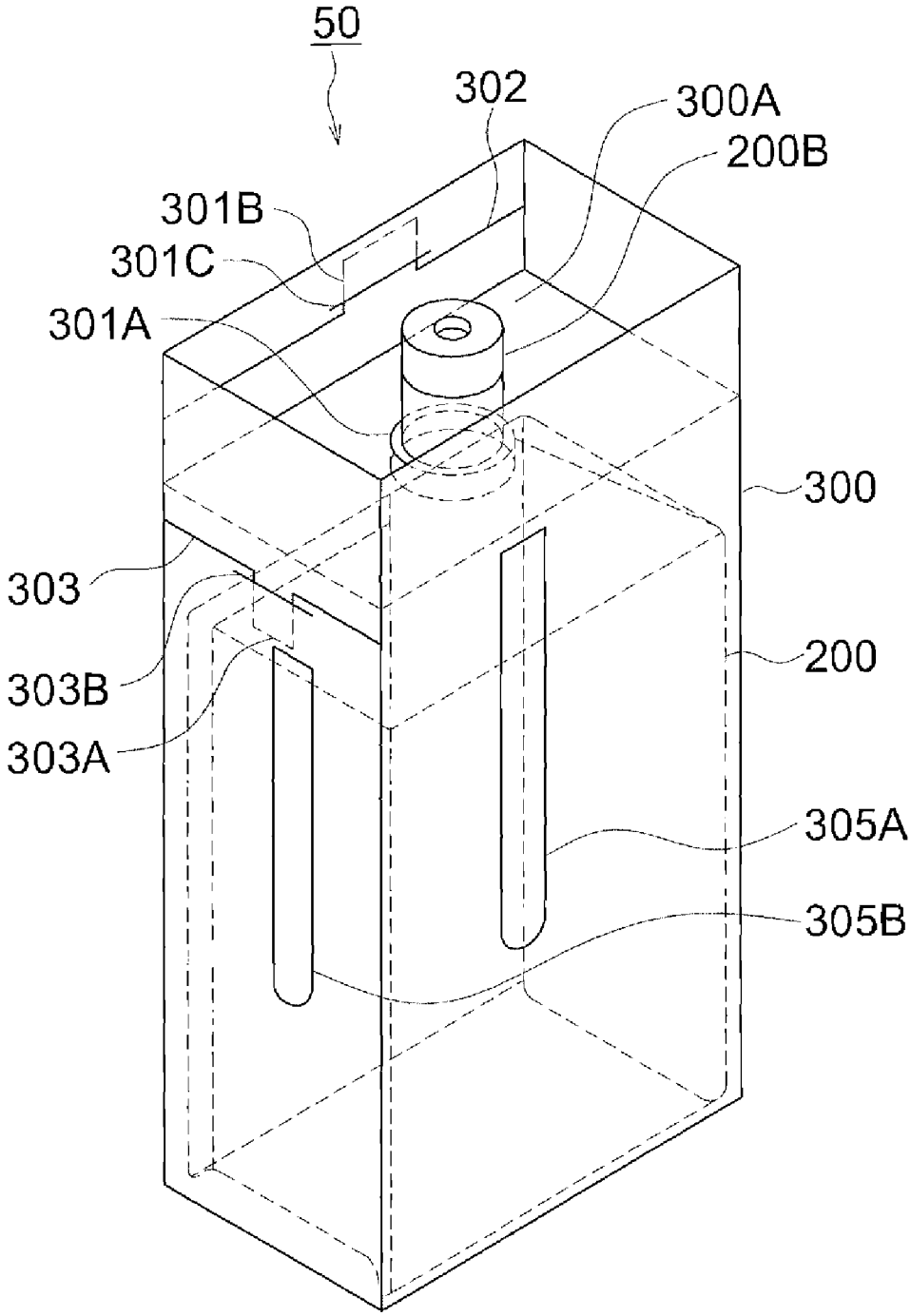
FIG. 1 is a schematic perspective view of an example of a toner cartridge of the present invention.

The toner cartridge 50 of FIG. 1 includes a toner storage container 200 and a packaging container 300 for packaging the storage container 200. The packaging container 300 also functions as a packaging material. It absorbs impact during the conveyance and reinforces the storage container 200 incorporated therein. The packaging container 300 is formed of a substance having an apparent density of 0.1 through 0.3. When impact is applied to the toner cartridge, the packaging container 300 absorbs the impact. During storage or conveyance in the high-temperature environment, the excellent heat insulation property of the packaging container 300 blocks heat so that it will not be transferred to the toner contained in the storage container 200. As described above, the packaging container 300 protects the storage container 200 and the toner incorporated in the storage container 200.

Further, on the market, the information used during the time from the shipment from the factory of the unitary package box to the arrival at the final user, and the information used when collecting the used cartridge are printed, for example, on the labels which can be bonded on the packaging container 300. The packaging container 300 is called a unitary package box, package box or packaging container on the market.

Figure 2:
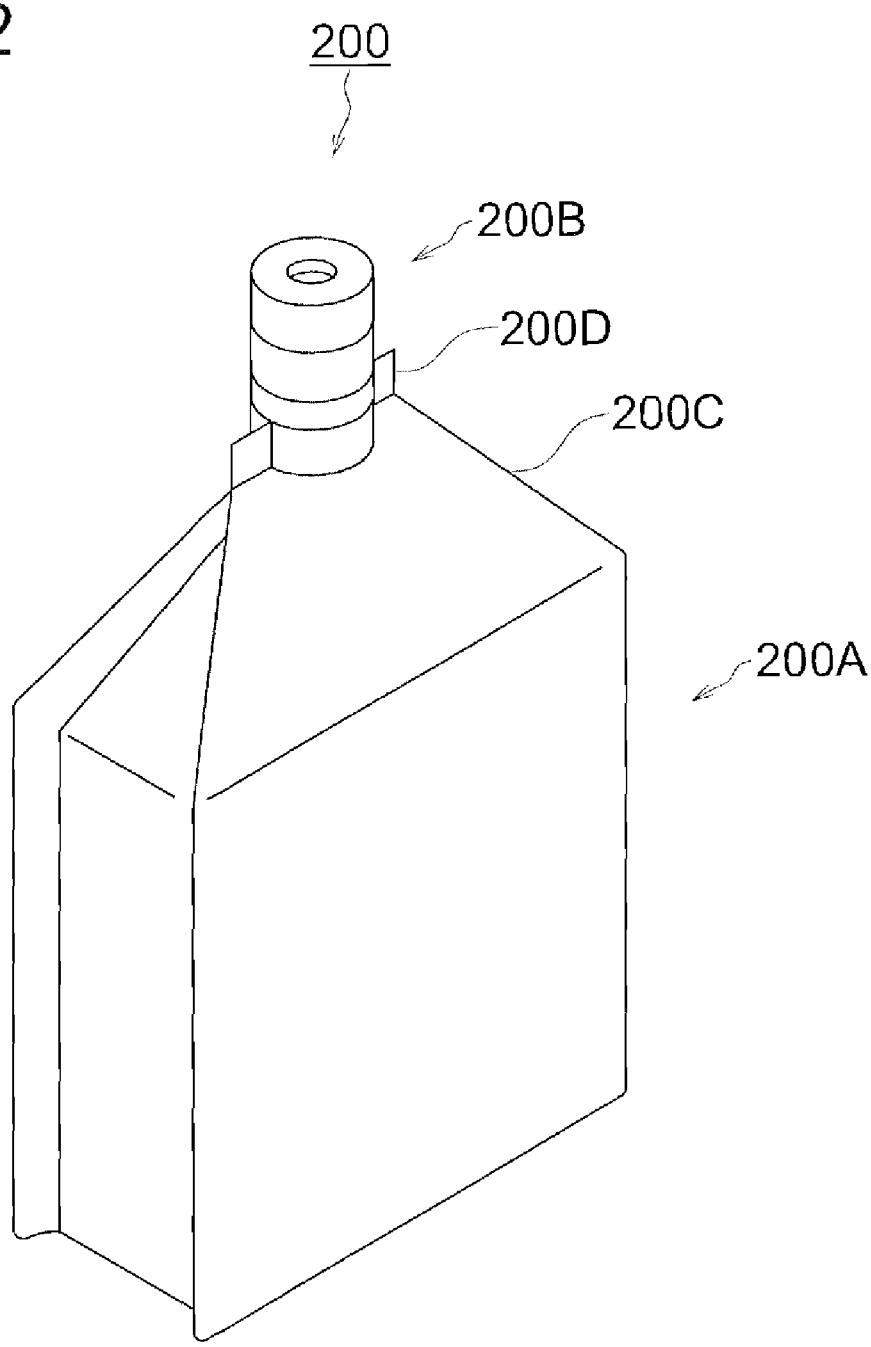
FIG. 2 is a schematic perspective view of a storage container 200 for storing toner.
Figure 3:
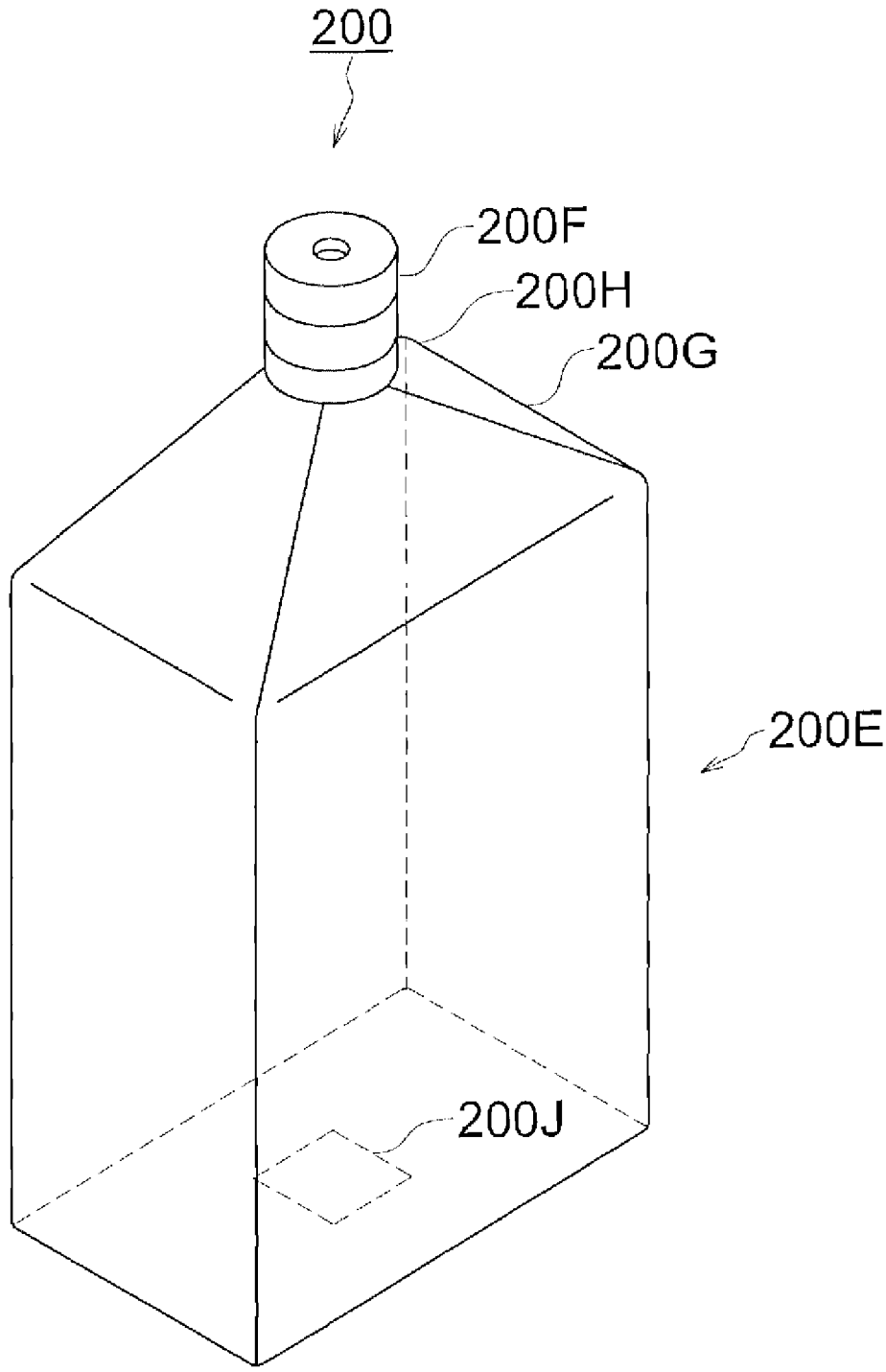
FIG. 3 is a schematic perspective view showing another embodiment of the storage container 200 for storing toner.

Referring to FIG. 1 through FIG. 3, the following describes the toner cartridge 50.

FIG. 1 is a schematic perspective view of a toner cartridge 50. Of the side surfaces forming a packaging container 300, the opening 300A that can be opened or closed is opened in such a way that the nozzle member 200B is exposed to the outside, wherein this nozzle member 200B corresponds to the supply section for supplying the image forming apparatus with the toner stored in the storage container 200. In the conventional art, when the toner cartridge 50 is to be mounted on the image forming apparatus, only the storage container 200 is mounted on the image forming apparatus. There has been no case where the storage container is mounted together with the packaging container 300. In the present invention, when the toner cartridge 50 is to be mounted on the image forming apparatus, the storage container 200 packaged in the packaging container 300 is mounted on the image forming apparatus. This arrangement solves the problem of requiring much time and efforts in storing the packaging container 300 during supply of toner.

Although not illustrated, a detection piece (fool proof) and IC chip can be attached to the toner cartridge 50.

Further, as shown in FIG. 1, the toner cartridge 50 allows the packaging container 300 to be provided with small windows 305A and 305B for checking the amount of remaining toner inside the storage container 200.

FIG. 2 is a schematic perspective view of a storage container 200. FIG. 3 is a schematic perspective view showing another embodiment of the storage container 200.

As shown in FIG. 2, the storage container 200 contains a flexible bag 200A such as polyethylene and nylon for storing toner, and a nozzle member 200B representing the supply section for charging and discharging toner.

As illustrated, the bag 200A contains a funnel section 200C for smooth ejection of toner. The narrower leading end 200D of the funnel section 200C is bonded and secured in the sealed state so as to enclose the nozzle member 200B.

As described, for example, in the Unexamined Japanese Patent Application Publication No. 2005-309168, the bag 200A can be manufactured as a plurality of sheet members constituting each side surface are bonded with each other.

The details of the nozzle member 200B are described later.

FIG. 3 is a schematic perspective view showing another embodiment of the storage container 200. This storage container 200 is made up of a bag 200E for storing the toner manufactured by blow molding or the like, and a nozzle member 200F for charging and discharging toner.

As shown in FIG. 3, the bag 200E has a funnel section 200G, and the narrower leading end 200H of the funnel section 200G is secured on the nozzle member 200F by bonding in a sealed state.

The nozzle member 200F has the same basic structure as that of the aforementioned nozzle member 200B.

A filter member 200J is secured on the bottom surface of the bag 200E by bonding. This arrangement is intended to ensure that, when toner is sucked by a powder pump (to be described later), the filter supplies air but not toner so that the interior of the bag 200E will not be exposed to excessive negative pressure.

Use of the storage container having a flexible bag, for example, eliminates the need of using a cushioning material, and provides a simple and compact cartridge structure. When the used cartridge is collected, a greater number of used cartridges can be loaded on a truck. Such advantages can be expected.

Figure 4:
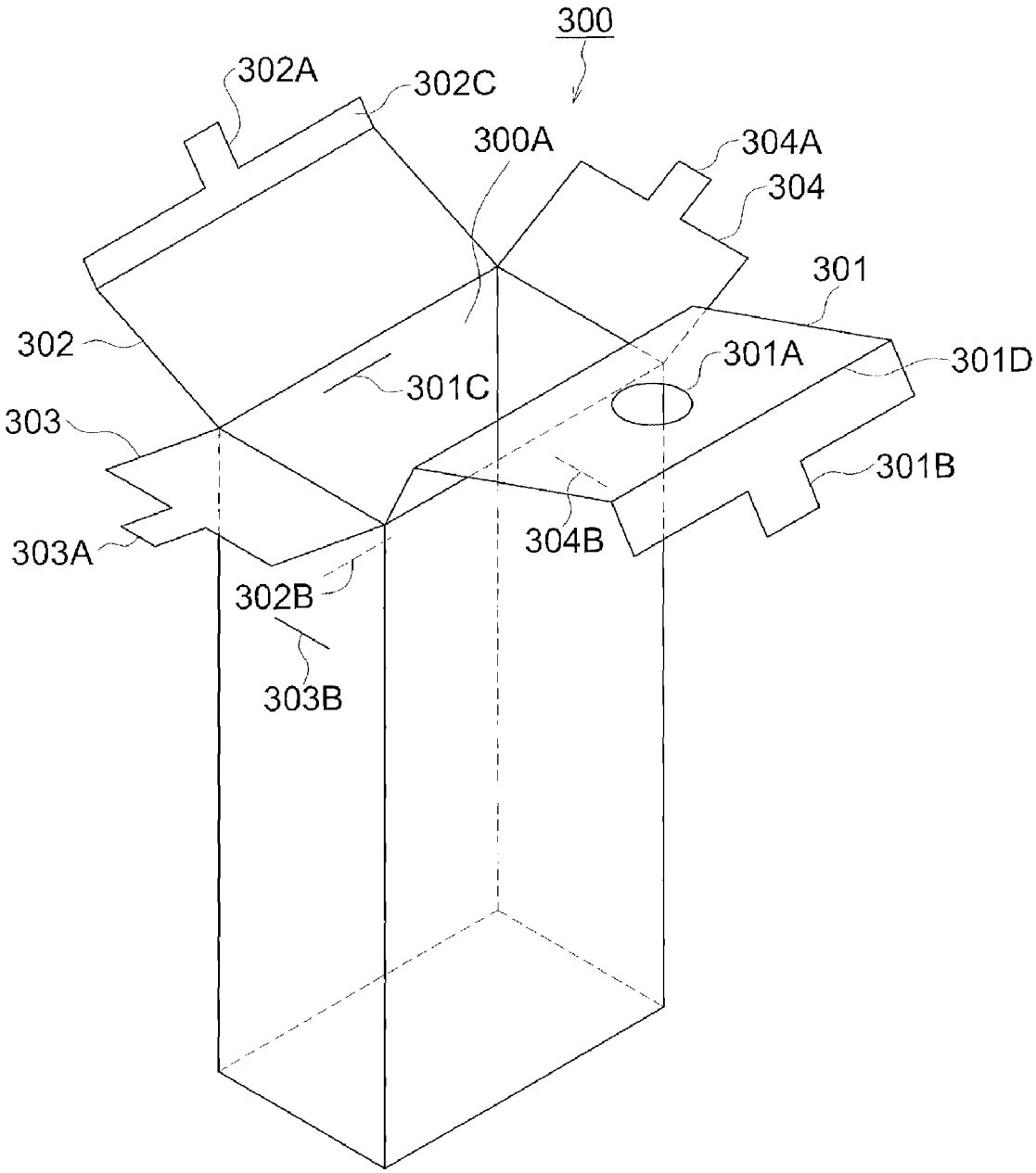
FIG. 4 is a schematic perspective view of a packaging container 300 for storing toner.

With reference to FIG. 4, the following describes the packaging container 300 for packaging the toner storage container 200. The packaging container 300 can be used at the time of transportation. It is strong enough to withstand the impact imposed at the time of transportation, and is weather-resistant so that printing on the container surface will not be adversely affected by rain.

The surface of the packaging container 300 can be printed with the product name, caution signal and check mark at the time of transportation.

Further, the packaging container 300 is manufactured by the material having an apparent density of 0.1 through 0.3. Use of the material having the apparent density within the aforementioned range ensures that the packaging container 300 is provided with heat insulation property as well as the aforementioned impact absorbency and weatherability. As a result, the toner that could not withstand a long-term storage and conveyance in the high-temperature environment, such as the toner having a low-temperature fixing property, can now be stored and conveyed under stable conditions without being affected by the fluctuation of outside air.

The material having the apparent density within the aforementioned range can be obtained by using, for example, paper such as a corrugated board and molded pulp material, resin material such as expandable polystyrene resin and polyester resin, a double-structured bag made of paper and resin, or a combination of these. The surface of these materials can be processed to permit transportation-related information to be printed.

The material that can be used in the packaging container 300 can be exemplified by a plastic-made corrugated board, paper-made corrugated fiberboard, expandable polyethylene, expandable polystyrene and expandable rubber. The packaging container 300 having density of 0.1 through 0.3 is manufactured by forming a cross sectional structure shown in FIG. 5 using these materials.

Of these materials, the plastic-made corrugated board provides a certain degree of transparency. This provides an advantage of checking the amount of remaining toner. Even when the packaging container 300 is manufactured using the material other than the plastic-made corrugated fiberboard, the windows 305A and 305B are provided, using a polyethylene terephthalate (PET) sheet and cellophane sheet, as shown in FIG. 1. This makes it possible to check the amount of toner remaining in the storage container.

As described above, the toner cartridge is provided with a small window to check the amount of remaining toner in the toner cartridge being used. This arrangement eliminates the need of the user stocking more than a necessary number of toner cartridges. This provides an advantage of avoiding excess inventory of cartridges. Especially when storing the toner for low-temperature fixing, the user cannot provide the same temperature control as that at the manufacturer or dealer for the storage of toner. However, the user can predict a correct time of ordering a new toner cartridge by checking the amount of remaining toner through the small window. This arrangement facilitates the stock control of the toner cartridge on the part of the user, and eliminates the possibility that the toner having been coagulated by heat is used for image forming.

An apparent density of the material applicable to the packaging container 300 can be measured according to the following procedure, for example: FIG. 6 outlines the procedure of manufacturing a material piece for measuring the apparent density using the packaging container 300. (1) Use a cutter to cut out a material piece from the packaging container 300. The size of the material piece can be as desired, but the material piece should be cut out from the portion which is not in contact with the collected material, wherever possible. (2) Cut this material piece to a predetermined size and get a rectangle having a length of "a" cm and width of "b" cm, as shown in FIG. 6. Also measure the thickness (t) of the material piece. (3) The material piece having been trimmed is placed on a chemical balance and the mass is measured. (4) The mass having been measured is divided by the volume of the material piece, and the resulting value is assumed as the apparent density. (5) For example, the packaging container 300 of FIG. 6 has a thickness of "t" cm, and a material piece having a length of "a" cm and width of "b" cm, is prepared. When the mass of this material piece is m (g), the apparent density of the material constituting the packaging container 300 is expressed by the following formula:

$$\text{Apparent density (density (g/cm}^3\text{))} = m(\text{g})/(a(\text{cm}) \times b(\text{cm}) \times t(\text{cm}))$$

The following methods can be used to ensure that the apparent density of the material constituting the packaging container 300 is 0.1 through 0.3. In one of these methods, when forming a material by assembling a sheet of paper or plate-formed plastic as in the case of a corrugated board, arrangements are made so that a space is formed between members. According to another method, when molding is performed in a die to produce the material as in the case of an expandable material, expansion molding is performed to form fine air bubbles in resin. Such methods can be mentioned as examples. When producing these materials, the space ratio, the amount of air supplied at the time of expansion molding are obtained by calculation in advance, and the material is designed, based on this calculation result. This procedure produces the material for packaging container having the aforementioned apparent density.

Figure 5:
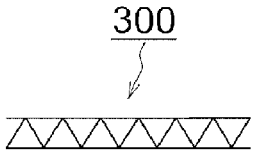
FIG. 5 is a schematic view representing the cross sectional structure of a material that can be used in the packaging container 300.
Figure 5:
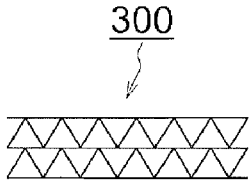
Figure 5:
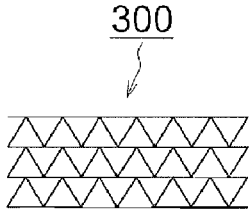
Figure 5:
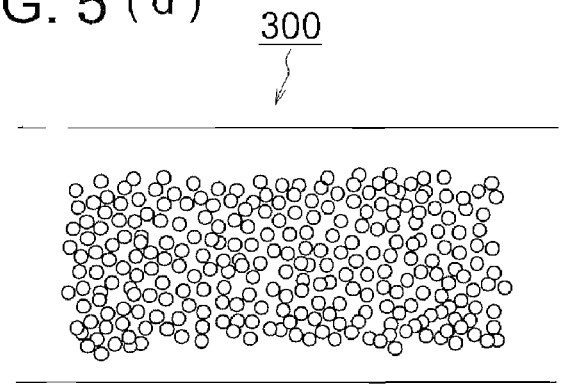
Figure 5:
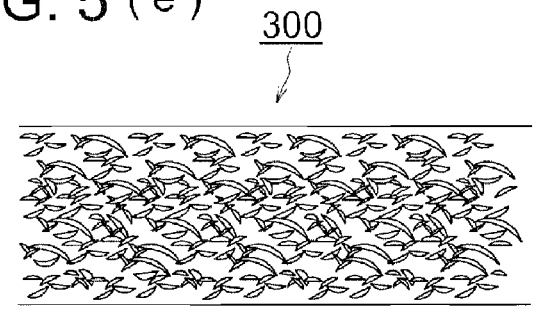
Figure 5:
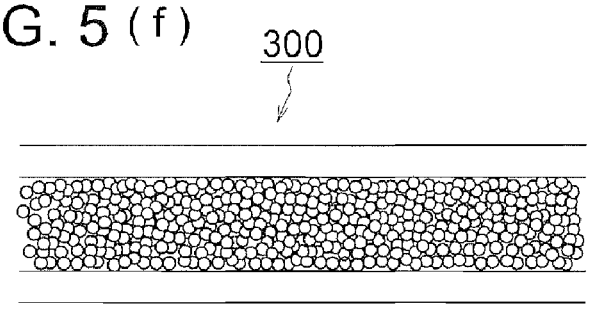

FIG. 5 shows the cross sectional structure of a material that can be used in the packaging container 300. The (a) through (c) of FIG. 5 indicate the materials having been assembled to form a space between the members such as a corrugated fiberboard. The (d) through (f) of FIG. 5 show the materials containing fine air bubbles in resin.

The material shown in FIG. 5(*a*) through FIG. 5(*c*) is typically represented by a corrugated fiberboard made of a medium. The corrugated fiberboard specified in the JIS Z 0108 has a structure wherein a flat medium called a liner is bonded on one or both sides of the corrugating medium (called corrugate). FIG. 5(*a*) shows what is called a two-sided corrugated fiberboard, wherein liners are bonded on both sides of the corrugated medium. FIG. 5(*b*) represents what is called a double wall double faced corrugated fiberboard, wherein a single faced corrugated fiberboard (corrugating medium bonded on one liner) is bonded on one side of the double faced corrugated fiberboard. FIG. 5(*c*) shows what is called a triple wall corrugated fiberboard wherein a single face corrugated fiberboard is bonded on one side of the double wall double faced corrugated fiberboard.

A plastic material such as polypropylene, polystyrene, polyethylene terephthalate (PET), acrylonitrile-styrene-butadiene copolymer (ABS) and polyethylene can be preferably used instead of the medium. When these resin materials are used, molding is performed so that the product will be transparent or translucent throughout the entire body.

FIGS. 5(*d*) through FIG. 5(*f*) show what is called a foaming material containing fine air bubbles. It is produced by mixing the foaming member with the resin material at the time of injection molding. The specific example of the foaming member includes a gas such as methane, butane, carbon dioxide gas, nitrogen and argon gas. An organic substance such as a piece of paper, a piece of wood and a bamboo fiber can be used as a foaming member. The organic substance such as a piece of paper, a piece of wood and a bamboo fiber are made up of very fine fibrous materials and contains very fine air bubbles.

FIG. 5(*d*) shows the structure wherein round air bubbles are dispersed in the resin phase. FIG. 5(*e*) shows the structure wherein an organic substance such as a piece of paper, a piece of wood and a bamboo fiber is dispersed in the resin phase. FIG. 5(*f*) shows a three-layered structure wherein a layer containing air bubbles is arranged between two resin layers.

When the packaging container 300 is manufactured using the material having the apparent density within the aforementioned range, the packaging container 300 is provided with heat insulation property. The toner storage container 200 packaged in the packaging container 300 can be stored and conveyed almost without being affected by the external environment. To be more specific, the heat of the toner cartridge external is transmitted over the surface of the packaging container 300, but there is a great decrease in the speed of heat transfer through the space in the corrugated fiberboard or the air bubble provided in the resin. Since there is a great decrease in the speed of heat transfer through the space in the packaging container 300 as described above, there is almost no transfer of external heat inside the packaging container 300 in contact with the toner storage container 200. Thus, toner storage container 200 is preserved without being affected by the fluctuation of outside air.

Referring to FIG. 4, the following further describes the packaging container 300. In the packaging container 300, the side surface opposite to the nozzle member 200B of the toner storage container 200 accommodating the toner storage container 200 is made up of a front flap 301, rear flap 302, left flap 303 and right flap 304.

The reference numeral 301A denotes a fitting holding hole arranged almost at the center of the front flap 301. As shown in FIG. 1, the diameter of the nozzle holding hole 301A is almost the same as that of the nozzle member 200B of the storage container 200. It performs the function of ensuring that the nozzle member 200B does not move when the storage container 200 is accommodated.

The reference numeral 301B denotes a tongue arranged on the leading end of the front flap 301. As shown in FIG. 1, it accommodates the storage container 200. When the front flap 301 is folded inside, the tongue 301B is engaged with the slit 301C arranged on the packaging container 300.

Since the tongue 301B is engaged with the slit 301C as described above, storage container 200 is prevented from jumping out downward, through collaboration with the nozzle holding hole 301A, when the nozzle member 200B of the storage container 200 is cast down for the purpose of supplying supply.

In addition to the aforementioned method, the storage container 200 can be fastened on the packaging container 300 by bonding the bag 200A of the storage container 200 on the packaging container 300 using a double-faced tape. For example, one surface of the bag 200A can be secured on the inner surface of the packaging container 300 by a double-faced tape T.

Once the bag 200A is fastened in position as described above, bag 200A shrinks evenly when toner is sucked from the storage container 200. This arrangement prevents the part of the bag 200A being bent, and toner from remaining therein.

Uniform shrinkage of the bag 200A eliminates the need of bonding a reinforcing member such as a PET (polyethylene terephthalate) sheet on the surface, for example. This contributes to a further reduction in the weight of the bag 200, as well as further saving of resources and costs.

The leading ends of the rear flap 302, left flap 303 and right flap 304 are provided with the tongues 302A, 303A and 304A, respectively.

The tongues 302A, 303A and 304A are engaged with the slits 302B, 303B and 304B provided on the packaging container 300 corresponding respectively, when toner is supplied.

Figure 7:
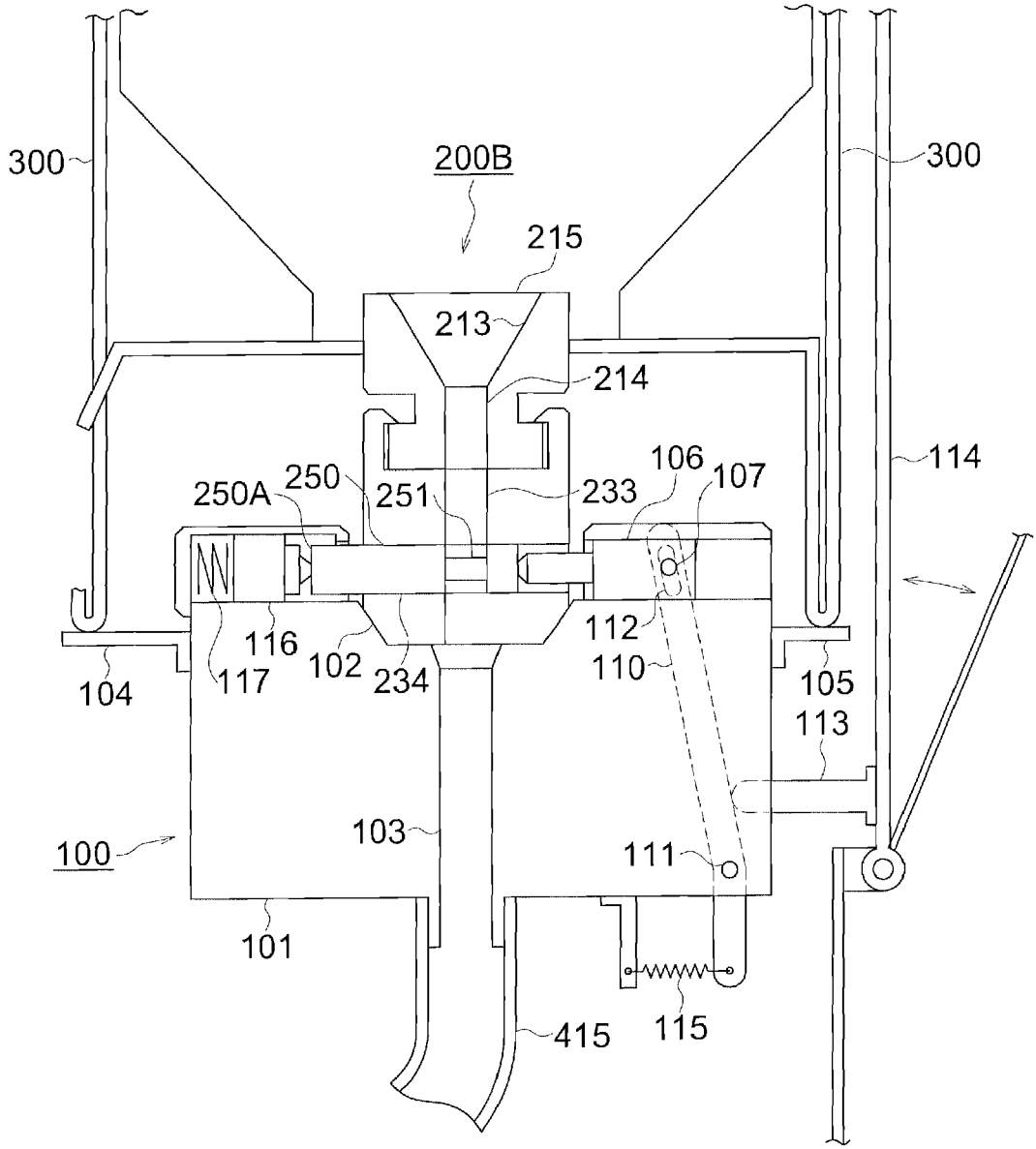
FIG. 7 is a cross sectional view of the toner replenishment section in the mage forming apparatus in FIG. 9 as observed along the line Z-Z.
Figure 8:
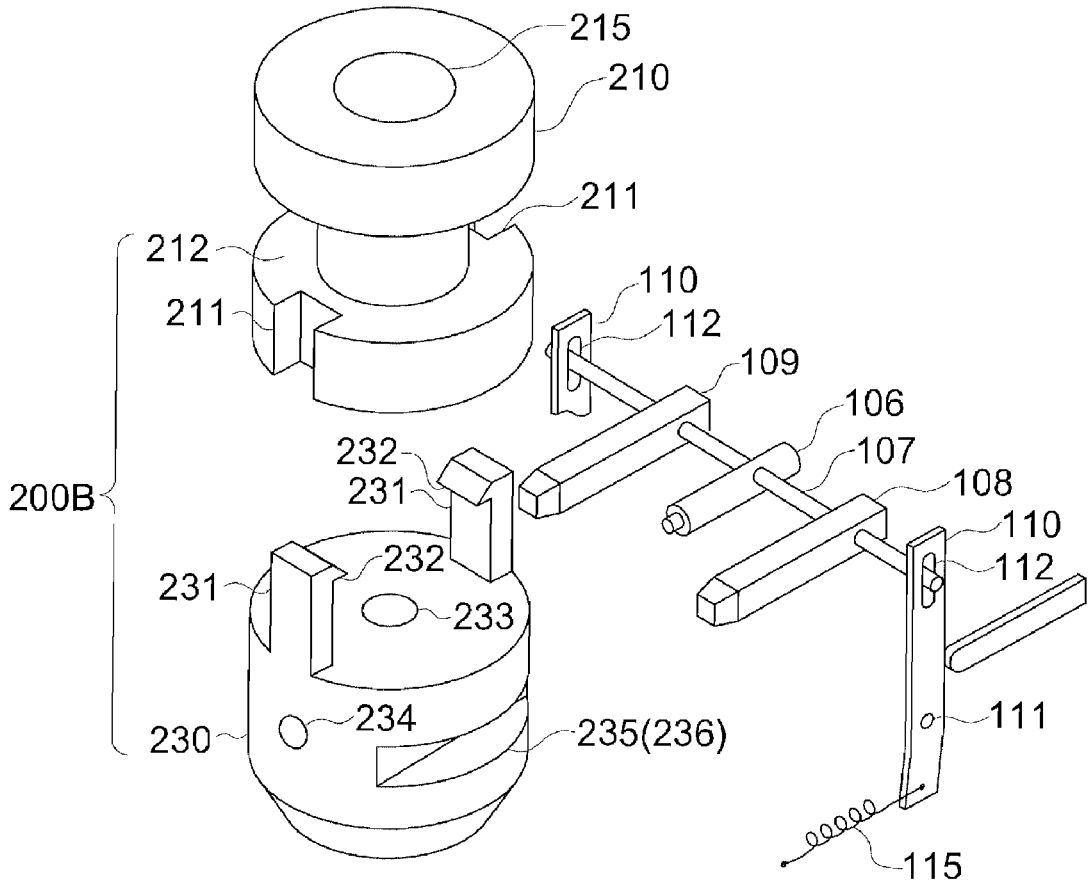
FIG. 8 is a schematic perspective view of the nozzle member 200B broken away for illustration.

The aforementioned engagement of the tongues 302A, 303A and 304A with the slits 302B, 303B and 304B ensures accurate and smooth mounting (or dismounting) of the packaging container 300 on the toner replenishment section 100 (FIG. 7 and FIG. 8).

A self-adhesive tape may be used to secure the tongues 302A, 303A and 304A on the side surface of the packaging container 300.

The following describes the procedure of forming the side surface opposite to the nozzle member 200B of the storage container 200 of the aforementioned packaging container 300.

The storage container 200 charged with toner is inserted in the packaging container 300, and the nozzle member 200B is inserted into the fitting holding hole 301A of the front flap 301. Then after being bent at the polygonal line portion 301D, the tongues 301B is engaged with the slit 301C from below.

After that, the left flap 303 and right flap 304 are folded inside, and the insertion part 302C of the rear flap 302 is inserted into the packaging container 300 in the final step.

Referring to FIGS. 7 and 8, the following describes the details of the nozzle member 200B corresponding to the supply section of the storage container 200.

Figure 11:
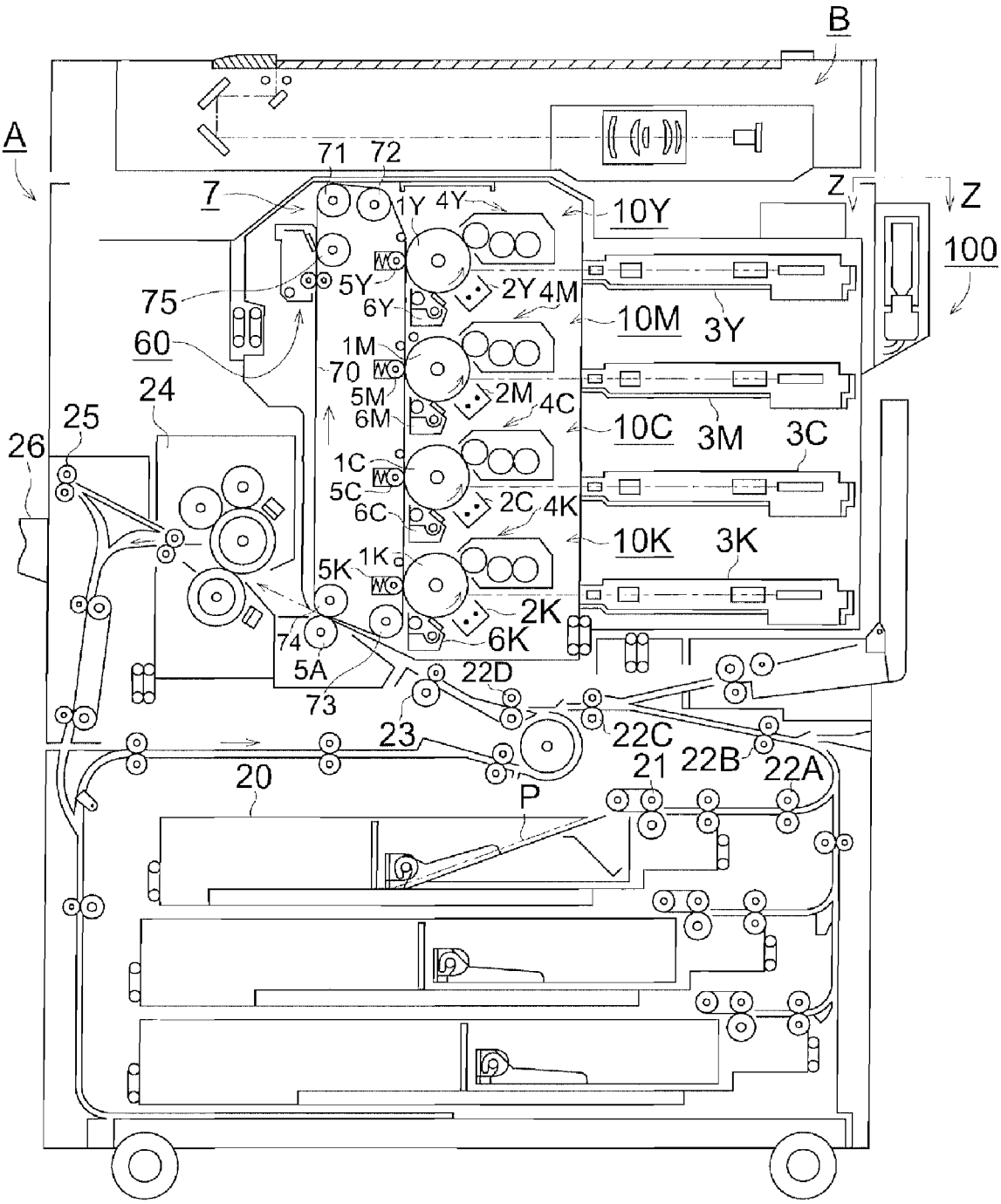
FIG. 11 is a schematic diagram representing tandem type color image forming apparatus.

FIG. 7 is a cross sectional view of the toner replenishment section 100 in the tandem type color image forming apparatus of FIG. 11 as observed along the line Z-Z. The nozzle member 200B of the storage container 200 is fitted and mounted on the toner replenishment section 100.

FIG. 8 is a schematic exploded perspective view of the nozzle member 200B. The nozzle member 200B is provided with a first nozzle member 210 and second nozzle member 230.

The second nozzle member 230 is provided with two locking portions 231. The locking portions 231 enters a concaved receiving section 211 arranged on the first nozzle member 210, and the claw 232 of the locking portions 231 is engaged with a jaw 212 of the first nozzle member 210. Then the first nozzle member 210 and the second nozzle member 230 are fastened at predetermined relative positions.

The first and second nozzle member 210 and 230 being fastened can be separated by pulling the second nozzle member 230 in the downward direction of FIG. 8.

A first toner outlet 215 made up of a tapered portion 213 wider toward the top in FIG. 8 and a cylindrical section 214 connected thereto is provided at the center of the first nozzle member 210. The first toner outlet 215 communicates with the second toner outlet 233 arranged on the second nozzle member 230.

The open/close member 250 arranged on the side of the image forming apparatus is slidable in a hole 234 arranged to cross the second toner outlet 233. The part thereof is provided with a cylindrical toner passage section 251 having a diameter smaller than that of the cylindrical section.

Referring to FIG. 7, FIG. 8, the following describes the details of the toner replenishment section 100 of the main body of the image forming apparatus (FIG. 11).

In FIG. 7, the reference numeral 101 denotes a toner receiving member to receive the toner storage container 200 and packaging container 300 which are to be fitted and mounted on the toner replenishment section 100. A tapered portion 102 matching with the tapered portion of the leading end of the second nozzle member 230 is formed approximately at the center.

The reference numeral 103 is a third toner outlet provided at the center of the toner receiving member 101. This toner outlet communicates the second toner outlet 233 of the second nozzle member 230 through the tapered portion 102. At the bottom end, the toner outlet is connected with the tube 415 connected to the suction portion of the powder pump (to be described later).

The reference numerals 104 and 105 denote the stoppers for receiving the packaging container 300. They are arranged in such a way that, when the tapered portion of the leading end of the second nozzle member 230 matches with the tapered portion 102 of the toner receiving member 101, the leading end of the packaging container 300 comes in engagement therewith.

The reference numeral 106 refers to a cylindrical pressure member held movably by the toner receiving member 101 in the lateral direction (in the horizontal direction) of FIG. 7. The cylindrical pressure member is arranged at such a position that, when the nozzle member 200B is loaded on the toner replenishment section 100, the centerline of the pressure member 106 matches with the centerline of the open/close member 250.

The reference numeral 107 represents a drive pin secured on the pressure member 106. It is arranged in the direction perpendicular to the centerline of the pressure member 106 (in the direction vertical to the sheet surface of FIG. 7).

As shown in FIG. 8, the reference numerals 108 and 109 are the rectangular positioning members fastened to the drive pin 107 on both sides of the pressure member 106, and are held movably by the toner receiving member 101 in the lateral direction (in the horizontal direction) of FIG. 8. The positioning members are located in such a way as to enter the concave positioning sections 235 and 236 of the second nozzle member 230 when the nozzle member 200B is loaded on the toner replenishment section 100.

The reference numeral 110 represents a drive lever which is provided so as to be rocked about a fulcrum 111 arranged on the toner receiving member 101. It has a slot portion 112, and the drive pin 107 is movably engaged with the slot portion 112.

As shown in FIG. 7, the reference numeral 113 indicates a drive lever pressure member fastened on the door 114. When the door 114 is closed, the leading end of the drive lever pressure member 113 is held in engagement with the intermediate position between the slot portion 112 of the drive lever 110 and the fulcrum 111 and is used to move the pressure member 106 and positioning members 108 and 109 to the left.

After this procedure, the positioning members 108 and 109 enter the position between the positioning sections 235 and 236 of the second nozzle member 230 so that the second nozzle member 230 is accurately fixed in position. At the same time, the pressure member 106 moves the open/close member 250 to the left so that the toner passage section 251 will be located as shown in FIG. 7, whereby toner can be supplied.

The reference numeral 115 is a drive lever return spring to return the drive lever 110 when the door 114 has been opened.

The reference numeral 116 is a cylindrical return member held by the toner receiving member 101 movably in the lateral direction (in the horizontal direction) of FIG. 7. The centerline thereof agrees with that of the open/close member 250.

The reference numeral 117 is a return spring to impose the return member 116 to move to the right in FIG. 7.

As shown in FIG. 7, when the door 114 is closed, the return member 116 is driven by the open/close member 250 to slide to the left. When the door 114 is opened, the return member 116 is driven by the return spring 117 to slide to the right. The open/close member 250 is pushed back until the leading end 250A of the second nozzle member 230 is aligned with the outer peripheral surface of the second nozzle member 230. To be more specific, it moves the toner passage section 251 to the right to interrupt passage of the toner.

The following describes the operation of each section to be performed in response to mounting or dismounting of the packaging container 300 of the aforementioned structure on the toner replenishment section 100.

Before mounting the packaging container 300 (FIG. 1 and FIG. 4) incorporating the storage container 200 on the toner replenishment section 100, the operator inserts members on the side opposite the nozzle member 200B i.e. the tongues 302A, 303A and 304A of the rear flap 302, left flap 303 and right flap 304, into the slits 302B, 303B and 304B.

This procedure allows the side opposite to the nozzle member 200B to be released, as shown in FIG. 1, and causes the opening 300A to be formed, and the nozzle member 200B to be exposed.

The following describes the procedure of mounting the packaging container 300 on the toner replenishment section 100, with reference to FIG. 9(*a*) and FIG. 9(*b*).

Figure 10:
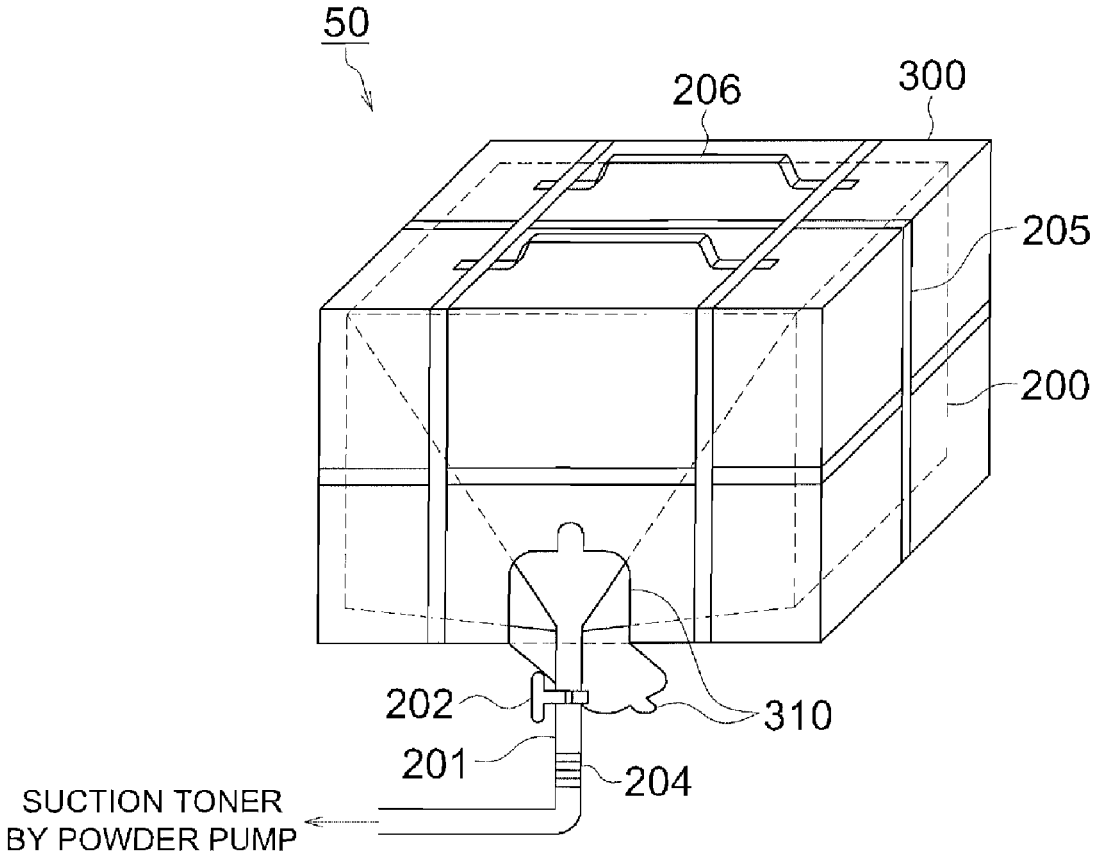
FIG. 10 is a schematic perspective view representing another embodiment of the toner cartridge of the present invention.

FIG. 9 is a side view in the vicinity of the toner replenishment section 100 of FIG. 10. FIG. 9(*b*) is a partial plan view of FIG. 9(*a*).

The operator opens the door 114. To mount the packaging container 300 of FIG. 1 accurately at a predetermined position, the operator inserts it in position along the guide plates 118 arranged at four positions until the leading end of the packaging container 300 comes in contact with stoppers 104 and 105 (FIG. 7), and the tapered portion of the second nozzle member 230 comes in contact with the tapered portion 102 of the toner receiving member 101.

After the operator has completed mounting of the packaging container 300 and has closed the door 114, the drive lever pressure member 113 is rocked in the counterclockwise direction of FIG. 7. This is accompanied by rocking of the drive lever 110 in the counterclockwise direction about the fulcrum 111.

Rocking of the drive lever 110 causes the positioning members 108 and 109 to be fed forward through the drive pin 107, and to be fed into the positioning sections 235 and 236 of the second nozzle member 230. Thus, the second nozzle member 230 is accurately and tightly fixed in position without being unseated. The pressure member 106 is also fed forward and the open/close member 250 is fed to the left so that the toner passage section 251 is located at the position shown in FIG. 7, whereby toner can be supplied.

The return member 116 is fed backward by the leftward traveling of the open/close member 250.

Upon completion of the aforementioned procedure, the operator operates the image forming apparatus. Then the toner contained in the storage container 200 is supplied into the image forming apparatus, as will be described later.

If the toner in the storage container 200 has been used up, the operator opens the door 114 to take out the packaging container 300.

As the door 114 is opened, the return member 116 moves the open/close member 250 back to a predetermined position in the second nozzle member 230. At the same time, the drive lever 110 is rocked about the fulcrum 111 in the clockwise direction through the action of the drive lever return spring 115.

When the drive lever 110 is rocked, the pressure member 106 and positioning members 108 and 109 move backward to be disconnected from the second nozzle member 230, and go back to a predetermined position.

The operator closes the rear flap 302, left flap 303 and right flap 304 of the packaging container 300 having been taken out, so that the used cartridge can be collected for recycling. In this way, the packaging container 300 remains without being removed from storage container. This arrangement ensures the operator to collect the used cartridge quickly and easily for reuse.

FIG. 10 is a schematic perspective view representing another embodiment of the toner cartridge that can be used in the present invention. In the toner cartridge of FIG. 10, an opening 310 is arranged below the packaging container 300 so that the toner supply section 201 of the storage container 200 is exposed to the outside. Before being mounted on the image forming apparatus, the opening 310 is constructed integrally with the packaging container 300. When mounted on the image forming apparatus, the opening 310 is cut off along the perforated line, whereby the toner supply section 201 is exposed to the outside.

The toner supply section 201 is provided with a cock 202 and fitting portion 204. When exposed to the outside through the opening 310 of the packaging container 300, the fitting portion 204 is connected to the image forming apparatus and the cock 202 is opened. Then toner of the storage container 200 is supplied to the image forming apparatus.

The outer periphery of the packaging container 300 is reinforced by a band 205 made of resin such as polyethylene. A grip 206 is provided removably on the upper part of the packaging container 300 through the band 205, thereby improving the workability at the time of installation on the image forming apparatus. The toner cartridge can also be secured onto the image forming apparatus through the grip 206.

Referring to the schematic diagram of a tandem type color image forming apparatus of FIG. 11, an embodiment of an image forming apparatus suitable for the aforementioned cartridge is explained.

The tandem type color image forming apparatus of FIG. 11 includes a plurality of image forming sections 10Y, 10M, 10C and 10K, an endless belt-shaped intermediate transfer member unit 7, sheet feed conveyance device (without reference numeral) and fixing device 24. A document image reading apparatus B is arranged on the upper portion of the main body A of the image forming apparatus.

The image forming section 10Y for yellow-colored image forming is provided with a photoreceptor 1Y as image carrier, a charging device 2Y around this photoreceptor 1Y, an exposure device 3Y, a development apparatus 4Y, a primary transfer roller 5Y, a cleaning device 6Y and others. Other image forming sections 10M, 10C and 10K are structured in the same way as the image forming section 10Y.

Each of the development apparatuses 4 contains the two-component developer (or one-component development) made up of toner of each color charged to have the same polarity as that of each photoreceptor 1, and contains a development roller as a developer carrier formed of a cylindrical non-magnetic stainless steel or aluminum material having a thickness of 0.5 mm through 1 mm and an outer diameter of 15 mm through 25 mm.

The development roller 41 is held in a contactless state by an abutting roller (not illustrated) at a predetermined space from the photoreceptor 1, e.g., at a space of 100 μm through 1000 μm. It rotates in the same direction as the photoreceptor 1 at a position opposite the photoreceptor.

At the time of development, the d.c. voltage having the polarity as that of toner or the development bias voltage obtained by superimposition of a.c. voltage upon the d.c. voltage is applied to the development roller 41, thereby causing reverse development in a state not in contact with the electrostatic latent image on the photoreceptor 1.

The intermediate transfer member unit 7 includes a plurality of rollers 71, 72, 73, 74 and 75, and a semiconducting, endless belt-shaped intermediate transfer member 70 as an image carrier.

The intermediate transfer member 70 is provided in a form circumscribing a drive roller 73 connected to a drive motor (not illustrated), support rollers 71 and 72, secondary transfer backup roller 74, and backup roller 75 to ensure that the intermediate transfer member 70 will rotate in the clockwise direction in FIG. 11.

A primary transfer roller 5 for each color is provided opposite the photoreceptor 1 through the intermediate transfer member 70. The d.c. voltage having the polarity reverse to that of the toner is applied to the primary transfer roller 5, and a transfer field is formed in the transfer area, whereby the toner image of each color formed on the photoreceptor 1 is primarily transferred onto the intermediate transfer member 70.

A secondary transfer roller 5A as an image forming device is arranged opposite the secondary transfer backup roller 74 through the intermediate transfer member 70. The d.c. voltage having the polarity reverse to that of toner is applied to the secondary transfer roller 5A, and a transfer field is formed in the transfer area, whereby the superimposed toner image carried on the intermediate transfer member 70 is secondarily transferred onto the surface of the transfer material (paper) P.

The sheet P is fed from the sheet feed cassette 20 by the sheet feed device 21, and is conveyed to the secondary transfer position through a plurality of the intermediate rollers 22A, 22B, 22C and 22D, and registration roller 23, whereby the color images are collectively transferred.

The sheet P with the color image transferred thereon is subjected to the process of fixing by the fixing device 24. Being sandwiched between ejection rollers 25, the sheet P is placed on the ejection tray 26.

A cleaning unit 60 for removing the toner remaining on the intermediate transfer member 70 is provided on the downstream side of the secondary transfer position, as viewed from the rotating direction of the intermediate transfer member 70.

The details of the development apparatus 4 will be described later.

The following describes the image forming process with reference to FIG. 11.

Upon start of the image recording, the drive motor (not illustrated) of the photoreceptor 1Y starts, and the photoreceptor 1Y of the yellow (Y) image forming section 10Y is driven in the direction shown by an arrow in FIG. 11 (in the counterclockwise direction). At the same time, a potential is applied to the photoreceptor 1Y by the charging by the charging section 2Y.

After potential has been applied to the photoreceptor 1Y, the exposure device 3Y causes the image writing operation to be initiated by the first color signal, namely, an electrical signal corresponding to the Y image data. The electrostatic latent image corresponding to the Y image of the document image is formed on the surface of the photoreceptor 1Y.

The aforementioned electrostatic latent image is subjected to reverse development by the development roller 41 in contact or contactless state, and a toner image is formed on the photoreceptor 1 in response to the rotation of the photoreceptor 1Y.

The toner image formed on the photoreceptor 1 by the aforementioned image forming process is transferred onto the intermediate transfer member 70 by the primary transfer roller 5. Then subsequent to synchronization with a toner image on the intermediate transfer member 70, the toner images of magenta (M), cyan (C) and black (K) are sequentially formed. Thus, a color toner image is formed on the intermediate transfer member 70.

The toner remaining on the surface of the photoreceptor 1 subsequent to transfer is removed by the cleaning unit 6.

Synchronously with formation of a color toner image on the intermediate transfer member 70, the sheets P having been conveyed by being separated one by one from the sheet feed cassette 20 is fed through the registration roller 23, and color toner images on the intermediate transfer member 70 are collectively transferred thereon by the secondary transfer roller 5A.

The sheet P subsequent to transfer is electrically discharged by the separation unit (not illustrated), and is conveyed to the fixing apparatus 24. Upon fixing of the toner image, the sheet is ejected to the ejection tray 26 by the ejection roller 25.

The toner remaining on the surface of the intermediate transfer member 70 subsequent to transfer is removed by the cleaning unit 60.

Figure 12:
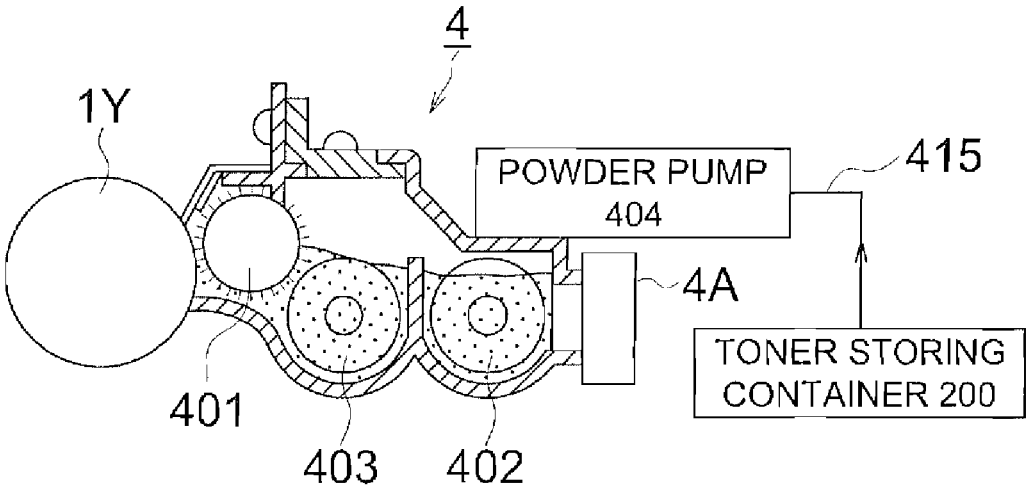
FIG. 12 is a schematic diagram representing the internal structure of a development apparatus 4 and a toner replenishment section.

The development apparatus 4 includes the development sleeve 401 arranged opposite the photoreceptor 1, first agitating screw 402 and second agitating screw 403, as shown in FIG. 12. In the development apparatus 4, the developer is conveyed and circulated by the first agitating screw 402, and, the second agitating screw 403. During this circulation of the developer, the electrostatic latent image formed on the photoreceptor 1 is developed by the developer transferred to the development sleeve 401 at some midpoint of the sheet conveyance path. The reference numeral 4A denotes a toner density sensor.

A powder pump 404 is mounted on the top of the development apparatus 4. The toner stored in the storage container 200 of the toner cartridge 50 is supplied into the development apparatus 4.

The following describes the toner that can be used in the present invention. In the present invention, it is possible to use the toner having a volume-based median diameter (D50) of 3.5 μm through 8.5 μm, wherein the resin contained therein has a glass-transition temperature of 0° C. through 46° C. and a softening point of 75° C. through 110° C.

The toner used in the present invention contains the resin having a glass-transition temperature of 0° C. through 46° C., preferably 30° C. through 50° C., and a softening point of 75° C. through 110° C., preferably 80° C. through 99° C. Inclusion of the resin having a glass-transition temperature and softening point within the aforementioned range allows a toner image to be melted and fixed on a transfer sheet at the temperature much lower than the conventional temperature.

The toner that permits image formation at a fixing temperature lower than the conventional level is typically represented by the toner having a core shell structure. The toner particles having a core shell structure has a structure wherein a shell layer is arranged on the core particles surface. The following describes the toner particles having a core shell structure.

The core particles constituting the core shell structure contain at least a binding resin and coloring agent. Further, a plurality of types of binding resins having different glass-transition temperatures and softening points can be contained for the purpose of ensuring compatibility between low-temperature fixing performance and mechanical strength. For example, when the toner used in the present invention is designed as a core shell structure toner, the toner characterized by compatibility between low-temperature fixing performance and mechanical strength is expected to be manufactured, if the resin having a glass-transition temperature of 0° C. through 46° C. and a softening point of 75° C. through 110° C. is contained as a core.

The toner having a core shell structure is manufactured by the following procedure, for example: Resin particles are formed by the polymerization method called the suspension polymerization, emulsion polymerization or multiple-layer polymerization. The resin particles having been formed are coagulated and fused together with the coloring agent particles (or coloring resin particles) in the presence of a coagulant, whereby the core particles are manufactured. Separately prepared resin particle dispersion is added to the core particles (coagula between resin particles and coloring agent particles) having been formed so that at least one shell layer is created on the core. In this way, toner particles including a core shell structure are produced by the process of forming a shell layer on the core surface.

Addition of an external additive to the toner particles having been generated produces the toner having a core shell structure. The specific method for manufacturing the toner having a core shell structure will be described later.

In the toner having a core shell structure, the glass-transition point of the resin constituting the core is normally lower than that of the resin constituting the shell.

The following describes how to measure the glass-transition temperature, softening point and volume-based median diameter of toner.

The glass-transition temperature of the toner constituting resin is measured by a DSC (differential scanning calorimeter). The point of a change in the inclination of the base line is expressed by the temperature corresponding to the crossing point of the tangential of the base line. To put it more specifically, the temperature rises to 100° C., and the sample is left standing for three minutes at that temperature. After that, the sample is cooled down to the room temperature at a falling temperature of 10° C. per minute. Then when this sample is measured at a rising temperature of 1020 C. per minute, the crossing point between the extension of the base line equal to or below the glass-transition point and the tangential exhibiting the maximum inclination subsequent to increase in the inclination relative to the base line temperature is expressed in terms of glass-transition temperature. The measuring instrument used in this case is exemplified by DSC-7 by Perkin-Elmer Inc.

The softening point of the resin constituting the toner can be measured by a flow tester. To put it more specifically, a flow tester "CFT-500" (by Shimadzu Seisakusho Ltd.) is used, and a sample of 1 $cm^3$ is melted and flown at a die pore diameter of 1 mm, a length of 1 mm, a load of 20 $kg/cm^2$, a temperature rising speed of 6° C. per minute, and a temperature rising start temperature of 50° C. In this case, the temperature corresponding to the point of flowing out 5 mm from the outflow starting point is defined as a softening point.

The toner that can be used in this invention has a volume-based median diameter (D50) of 3.5 μm through 8.5 μm, preferably 4.0 μm through 7.0 μm. If the volume-based median diameter is kept within the aforementioned range, a minute dot image on the level of 1200 dpi (dpi: number of dots per inch (2.54 cm) and a high-definition full-color pictorial image, for example, can be formed with high precision.

The volume-based median diameter of the toner can be measured and calculated by connecting Multisizer 3 (by Beckmann Coulter Inc.) with a computer loaded with a data processing program.

The following measuring procedure is used: After 0.02 g of toner has been sufficiently blended with 20 ml of surface active agent solution (e.g., a surface active agent solution obtained by diluting a neutral detergent containing a surface active agent component with demineralized water to a ratio of one to ten, for the purpose of dispersing toner), dispersion by ultrasonic wave is performed for one minute to produce toner dispersion. This toner dispersion is poured into the beaker containing ISOTONII (by Beckmann Coulter Inc.) inside the sample stand by a pipette until the measured density falls within the range of 5% through 10%, and the count of the measuring instrument is set at 2,500, whereby measurement is started. The Multisizer 3 having an aperture diameter of 50μm was used in this test.

The following describes the elements constituting the toner that can be used in the present invention.

The resin that can be used for each of the core and shell of the toner that can be used in the present invention is exemplified by a polymer obtained by polymerization of the following polymerizable monomer:

The polymerizable monomer is exemplified by: styrene or styrene derivative such as styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-desylstyrene and p-n-dodecyl styrene; methacrylate ester derivative such as methacrylate methyl, methacrylate ethyl, methacrylate n-butyl, methacrylate isopropyl, methacrylate isobutyl, methacrylate t-butyl, methacrylate n-octyl, methacrylate 2-ethylhexyl, methacrylate stearyl, methacrylate lauryl, methacrylate phenyl, methacrylate diethyl amino ethyl and methacrylate dimethyl amino ethyl;

acrylic acid ester derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate;

olefins such as ethylene, propylene and isobutylene;

vinyl esters such as vinyl propionate, vinyl acetate and vinyl benzoate;

vinyl ethers such as vinyl methyl ether and vinyl ethyl ether;

vinyl ketones such as vinyl methyl ketone, vinyl ethyl ketone and vinyl hexyl ketone;

N-vinyl compound such as N-vinyl carbazole, N-vinyl indole and N-vinyl pyrrolidone;

vinyl compounds such as vinyl naphthalene and vinyl pyridine;

acrylic acid such as acrylonitrile, methacrylo nitrile and acrylamide; and methacrylate derivative.

These vinyl based monomers can be used independently or in combination.

The substances containing ionic dissociation group can also be combined for use, as exemplified by those containing a substituent such as a carboxyl group, sulfonic acid group and phosphoric acid group as a constituent group of the monomer. To put it more specifically, they are acrylic acid, methacrylate, maleic acid, itaconic acid, cinnamic acid, fumaric acid, maleic acid monoalkyl ester, itaconic acid monoalkyl ester, styrene sulfonic acid group, alyl sulfosuccinic acid, 2-acrylamide-2-methylpropane sulfonic acid and acid phosphoxy ethylmethacrylate.

Further, a resin of crosslinking structure can be produced by using the multifunctional vinyl such as divinyl benzene, ethylene glycol dimethacrylate, ethylene glycol diacylate, diethylene glycol dimethacrylate, diethylene glycol diacylate, triethylene glycol dimethacrylate, triethylene glycol diacylate, and neopentyl glycol dimethacrylate and neopentyl glycol diacylate.

The following describes the waxes that can be used for toner. These waxes include those that have been known so far in the conventional art. They are: a polyolefin wax such as polyethylene wax and polypropylene wax;

a long chain hydrocarbon based wax such as paraffin wax and sasol wax;

a dialkyl ketone based wax such as distearyl ketone;

an ester based wax such as carnauba wax, montan wax, trimethylol propane tribehenate, pentaerithritol tetramyristate, pentaerithritol tetrastearate, pentaerithritol tetrabehenate, pentaerithritol diacetate dibehenate, glycerinetribehenate, 1,18-octadecane diol distearate, tristealyl trimellitate, and distearyl maleate; and an amide based wax such as ethylene diamine dibehenylamide and tristealylamide trimellitate.

The melting point of the wax is normally 40° C. through 160° C., preferably 50° C. through 120° C., more preferably 60° C. through 90° C. When the melting point is kept within the aforementioned range, the heat-resistant storage stability of toner is ensured, and such a trouble as cold offset does not occur even when low-temperature fixing is performed. Stable toner image forming is provided. Further, the amount of wax contained in the wax is preferably 1 percent by mass through 30 percent by mass, more preferably 5 percent by mass through 20 percent by mass.

The coloring agent that can be used is exemplified by the following:

The black coloring agent is exemplified by a carbon black such as a furnace black, channel black, acetylene black, thermal black and lamp black, as well as a magnetic substance such as a magnetite and ferrite.

Further, the coloring agents of magenta or red include C.I. pigment red 2, C.I. pigment red 3, C.I. pigment red 5, C.I. pigment red 6, C.I. pigment red 7, C.I. pigment red 15, C.I. pigment red 16, C.I. pigment red 48;1, C.I. pigment red 53;1, C.I. pigment red 57;1, C.I. pigment red 122, C.I. pigment red 123, C.I. pigment red 139, C.I. pigment red 144, C.I. pigment red 149, C.I. pigment red 166, C.I. pigment red 177, C.I. pigment red 178 and C.I. pigment red 222.

The coloring agents for orange or yellow include C.I. pigment orange 31, C.I. pigment orange 43, C.I pigment yellow 12, C.I. pigment yellow 13, C.I. pigment yellow 14, C.I. pigment yellow 15, C.I. pigment yellow 17, C.I. pigment yellow 93, C.I. pigment yellow 94 and C.I. pigment yellow 138.

The coloring agents for green or cyan include C.I. pigment blue 15, C.I. pigment blue 15;2, C.I. pigment blue 15;3, C.I. pigment blue 15;4, C.I. pigment blue 16, C.I. pigment blue 60, C.I. pigment blue 62, C.I. pigment blue 66 and C.I. pigment green 7.

These coloring agents can be used independently or in combination, as required. Further, the amount of coloring agent to be added is set at 1 through 30 percent by mass, with respect to the total amount of toner, preferably 2 through 20 percent by mass.

The following describes the typical method of manufacturing the toner that can be used in the present invention:

The following methods, for example, can be used to manufacture the toner having a core shell structure that can be used in the present invention—(1) a melting/dispersion process for melting or dispersion in the radical polymerizable monomer; (2) a polymerization process for preparing the dispersion of resin particles; (3) a coagulation/fusion process for obtaining core particles (associated particles) by coagulation, fusion of resin particles and coloring agent particles in the aqueous medium; (4) a first curing process for curing associated particles by thermal energy and regulating the shape; (5) a shell forming process wherein resin particles for shell are added into the dispersion of core particles (associated particles) to cause coagulation and fusion of the shell particles, whereby the colored particles of core shell structure are formed on the core particles surface; (6) a second curing process for curing the colored particles of core shell structure by thermal energy and regulating the shape of the colored particles of core shell structure are cured; (7) a cleaning process for separating between the solid and liquid of colored particles from the colored particle dispersion having been cooled, and removing the surface active agent and others from these colored particles; (8) a drying process for drying the colored particles having been cleaned; and (9) a process of adding external additives to dried colored particles, subsequent to the drying process, if required. The aforementioned processes will be described later.

When the toner having a core shell structure is manufactured, colored particles as a core (hereinafter referred to as "core particles") are manufactured by association and fusion between resin particles and coloring agent particles. Then resin particles are added into the core particle dispersion to cause coagulation and fusion of these resin particles to the core particles surface, whereby the core particles surface is covered, and colored particles having a core shell structure are manufactured. As described above, the toner having a core shell structure is manufactured by adding resin particles into the dispersion of core particles manufactured by various production methods, and fusing the resin particles on the core particles surface.

The core particles constituting the toner of core shell structure are manufactured by coagulation and fusion between the resin particles and coloring agent particles. The shape of core particles is controlled by controlling the heating temperature in the coagulation/fusion process and heating temperature and time in the first curing process. To be more specific, when a lower heating temperature is used in the coagulation/fusion process, the progress of fusion between resin particles is checked, and deformation is promoted. Further, the deformed shape of the core particles can be controlled by setting a lower heating temperature and shorter time in the first curing process.

Of these methods, time control in the first curing process is most effective. The curing process is intended to regulate the circularity of the associated particles. If this time is prolonged, associated particles will be shaped closer to perfect sphericity.

The following describes the details of the method of manufacturing the toner of the aforementioned core shell structure:

To manufacture the core section constituting the toner of the present invention, the wax component is dissolved and dispersed in the polymerizable monomer forming the resin, for example. Then mechanical particles are dispersed in the aqueous medium, and the polymerizable monomer is polymerized according to the mini-emulsion polymerization method. The composite resin particles and coloring agent particles formed through this process are salted out and fused, whereby particles are associated. This method is preferably employed. The mold releasing agent component can be dissolved or melted in the polymerizable monomer.

The core section is preferably manufacturing according to the process of salting out and fusion of the composite resin particles and coloring agent particles including the resin obtained by the multi-polymerization method. To put it more specifically, the following methods can be mentioned:

[Melting/Dispersion Process]

In this process, the mold releasing agent compound is dissolved in the radical polymerizable monomer, and the radical polymerizable monomer solution mixed with the mold releasing agent compound is prepared.

[Polymerization Process]

In a preferred example of this polymerization process, the radical polymerizable monomer solution containing the melted or dispersed mixture of the aforementioned ester compound is added in the aqueous medium including the surface active agent without exceeding critical micelle density (CMC). Then mechanical energy is applied thereto to form a liquid particle. After that, a water-insoluble radical polymerization initiator is added to promote the polymerization reaction in this liquid particle. An oil soluble polymerization initiator may be included in the aforementioned liquid particles. In such a polymerization process, it is essential to provide mechanical energy and to apply a process of forcible emulsification (formation of liquid particles). A device for providing such mechanical energy is exemplified by the device for providing strong agitation or ultrasonic wave vibration energy such as a homo-mixer, ultrasonic wave and Manton-Gaulin.

The aforementioned polymerization process provides the resin particles including the mixture of ester compound and binding resin. Such resin particles can be colored particles or uncolored particles. The colored resin particles can be obtained by polymerization of the monomer composition containing the coloring agent. When uncolored resin particles are used, the dispersion of coloring agent particles is added to the dispersion of resin particles in the coagulation/fusion process (to be described later). Thus, colored particles can be obtained by fusion of the resin particles and coloring agent particles.

[Coagulation/Fusion Process] (Including the First Curing Process)

The salting out/fusion method using the resin particles (colored or non-colored resin particles) obtained by the polymerization process is preferably employed as a method for coagulation and fusion in the aforementioned fusion process. Further, together with the resin particles and coloring agent particles, internal additive particles such as mold releasing agent particles and electric charge inhibitor can be coagulated and fused in the coagulation/fusion process.

The salting out/fusion method in the sense in which it is used here refers to a method of association wherein coagulation and fusion are performed in parallel at the time of associating the particles, and, when particles have grown up to a desired particle diameter, a coagulation terminator is added to terminate the growth of the particles. In this case, heating is continued, if required, to control the shape of the particles.

The "aqueous medium" in the aforementioned coagulation/fusion process refers to the medium wherein water is the main component (50 percent by mass or more). In this case, an organic solvent that dissolves in water can be mentioned as one of the components other than water. It is exemplified by methanol, ethanol, isopropanol, butanol, acetone, methyl-ethyl ketone and tetrahydrofuran.

The coloring agent particles can be prepared by dispersing the coloring agent in the aqueous medium. The coloring agent is dispersed when the surface active agent density equal to or greater than the critical micelle density (CMC) under water. There is no restriction to the type of the equipment used to disperse the coloring agent. The equipment that can be preferably used includes an ultrasonic wave homogenizer, mechanical homogenizer, pressure type homogenizer such as a Manton-Gaulin and pressure type homogenizer, sand grinder, Getzmann mill, diamond fine mill and a medium type homogenizer. The aforementioned surface active agents can be mentioned as the surface active agent to be used. The coloring agent (particles) may have been subjected to surface modification. Surface modification of the coloring agent was performed by dispersing a coloring agent in solvent and adding a surface modifying agent to that molecular weight solution. The temperature was raised to cause reaction of this system. Upon completion of reaction, the coloring agent was filtered, and cleaning and filtration were repeated using the same solvent. After that, it was dried to get a coloring agent (pigment) processed by surface modifying agent.

In the salting out/fusion method, which is a preferred method for coagulation and fusion, an alkaline metal salt, alkaline earth metal salt and salting agent made up of a trivalent salt and others are added in water containing resin particles and coloring agent particles as a coagulant having a density equal to or greater than the critical coagulation density. Then the solution was heated at the glass-transition temperature equal to or greater than that of the aforementioned resin particles, to reach the temperature equal to or greater than the melting peak temperature (° C.) of the aforementioned mixture, whereby salting is promoted. At the same time, fusion is carried out in this process. An alkaline metal salt and alkaline earth metal salt are as a salting agent. Lithium, potassium and sodium can be mentioned as an alkaline metal. Magnesium, calcium, strontium and barium can be mentioned as an alkaline earth metal. Potassium, sodium, magnesium, calcium and barium are preferably used.

When the salting out/fusion method is used to cause coagulation and fusion, it is preferred to minimize the time for leaving the solution to stand subsequent to addition of the salting agent. The reason for this is not very clear. A fluctuation in the state of coagulation of the particles is caused by the time for leaving the solution to stand subsequent to salting out. This will result in unstable distribution of the particle diameter and will raise a problem of fluctuation in the surface property of the surface of the used toner. Further, the temperature for adding the salting agent should be equal to or less than the glass-transition temperature of resin particles. This can be explained as follows: If the temperature for adding the salting agent is greater than the glass-transition temperature of resin particles, the particle diameter cannot be controlled, even if the salting out/fusion of resin particles proceeds at a higher speed. This will cause such a problem as production of the particles of larger particle diameter. The temperature for adding the salting agent should be equal to or less than the glass-transition temperature of the resin. This temperature is generally 5° C. through 55° C., preferably 10° C. through 45° C.

The salting agent is added at the temperature equal to or less than the glass-transition temperature of the resin particles. After that, the temperature is increased as quickly as possible. The solution is heated at the glass-transition temperature equal to or greater than that of the resin particles, to reach the temperature equal to or greater than the melting peak temperature (° C.) of the aforementioned mixture. The time duration for this temperature rise is preferably less than one hour. This requires quick temperature rising operation. The temperature rising speed is preferably equal to or greater than 0.25° C. per minute. The upper limit is not yet clear, but the abrupt rise of temperature will cause the salting out operation to proceed quickly. This makes it difficult to control the particle diameter. Thus, the preferred speed is equal to or less than 5° C. per minute. This fusion process provides the dispersion of associated particles (core particles) created by salting out/fusion of resin particles and desired particles.

The heating temperature in the coagulation/fusion process and the heating temperature and time in the first curing process are controlled in such a way that the formed core particles will have a roughened structure. To put it more specifically, a lower heating temperature is used in the coagulation/fusion process and the progress in the fusion among resin particles is controlled to promote deformation. Alternatively, a lower heating temperature and shorter time are used in the first curing process, wherein core particles are controlled to be roughened.

[Shell Making Process] (Including the Second Curing Process)

In the shell making process, a resin particles dispersion for shell is added into the core particles dispersion, and resin particles for shell are coagulated and fused on the core particles surface so that core particles surface is coated with resin particles for shell, whereby colored particles are formed.

To put it more specifically, while the temperature in the aforementioned coagulation/fusion process and the first curing process is kept unchanged, the dispersion of the resin particles for shell is added. While heating and agitation operations are continued, the core particles surface is coated with the resin particles for shell slowly for several hours, whereby colored particles are formed. The time for heating and agitation is preferably 1 through 7 hours, more preferably 3 through 5 hours. When the diameter of the colored particles has reached a predetermined level through formation of the shell, a terminator such as a sodium chloride is added to suspend the growth of particles. After that, to fuse the resin particles for shell attached onto the core particles, heating and agitation continue for several hours. In the shell making process, a shell having a thickness of 10 nm through 500 nm is formed on the core particles surface. In this manner, resin particles stick onto the core particles surface to form a shell. Thus, round and regular-shaped colored particles are produced.

Through the aforementioned process, round and regular-shaped colored particles are produced. Further, colored particles can be controlled to be shaped closer to perfect sphericity by setting a longer time in the second curing process or a higher curing temperature.

[Cooling Process]

This is the process of cooling (quenching) the dispersion of the aforementioned colored particles. Cooling is provided at a cooling speed of 1° C. through 20° C. per minute. There is no restriction to the method of cooling. Cooling can be provided by leading coolant from outside the reaction container, or by introducing coolant directly into the reaction system.

[Solid/Liquid Separation/Cleaning Process]

The solid/liquid separation/cleaning process contains a solid/liquid separation step for solid/liquid separation of the colored particles from the dispersion of colored particles cooled down to a predetermined temperature in the aforementioned process, and a cleaning step for removing such an deposit as a surface active agent or salting agent from the toner cake (wet colored particles coagulated in a form of a cake) having been subjected to the step of solid/liquid separation. In this case, there is no restriction to the method of filtration. A centrifugal separation method, vacuum filtration method based on Nutze and others or filter press can be used.

[Drying Process]

This is the process wherein the cleaned toner cake is dried to get dried colored particles. A spray dryer, vacuum frozen drying machine and vacuum drying machine can be mentioned as the drying machine that can be used in this process. Use of a standing rack drying machine, movable rack drying machine, fluid bed drying machine, rotary type drying machine and agitation type drying machine is preferred. The water content of the dried colored particles is preferably, equal to or less than 5 percent by mass, more preferably equal to or less than 2 percent by mass. When dried colored particles are coagulated by a weak attraction among particles, the coagula can be crushed. In this case, a mechanical type crushing apparatus such as a jet mill, Henschel mixer, coffee mill and food processor can be used as a crusher.

[External Addition Process]

In this process, dried colored particles are blended with an external additive, as required, whereby toner is manufactured.

The mechanical type blending machine such as a Henschel mixer and coffee mill can be used as an external additive blending apparatus.

The following describes the polymerization initiator, chain-transfer agent and surface active agent that can be used in the aforementioned toner manufacturing method.

The resin constituting the core and shell of the toner in the present invention is generated by polymerization of the aforementioned polymerizable monomer. Polymerization of the polymerizable monomer is started in the presence of a radical polymerization initiator. The following can be mentioned as the radical polymerization initiator. To put it more specifically, when resin particles are to be formed according to the method of suspension polymerization, the oil soluble polymerization initiator can be used. The oil soluble polymerization initiator that can be used is exemplified by an azo based substance such as 2,2'-azobis-(2,4-dimethylvaleronitrile), 2,2'-azobis isobutylo nitrile, 1,1'-azobis(cyclohexanone-1-carbonitrile), 2,2'-azobis-4-methoxy-2,4-dimethylvaleronitrile and azobisisobutyro nitrile; a peroxide based polymerization initiator such as a diazo polymerization initiator, benzoyl peroxide, methylethyl ketone peroxide, diisopropyl peroxy carbonate, cumene hydroperoxide, t-butyl hydro peroxide, di-t-butyl peroxide, dicumyl peroxide, 2,4-dichlorobenzoyl peroxide, lauroyl peroxide, 2,2-bis-(4,4-t-butyl peroxy cyclohexyl)propane, and tris-(t-butyl peroxy)triazine; and a macromolecule initiator having a peroxide on the side chain.

When resin particles are to be formed according to the method of emulsion polymerization, the water soluble radical polymerization initiator can be utilized. The water soluble polymerization initiator is exemplified by persulfide such as potassium peroxide and ammonium peroxide, as well as azobis amino dipropane acetate, azobiscyano valeric acid and valerate and hydrogen peroxide.

A dispersion stabilizer can be used to ensure that an adequate amount of polymerizable monomer or the like is dispersed in the reaction system. The dispersion stabilizer that can be used is exemplified by the following substances generally employed as surface active agents: tricalcium phosphate, magnesium phosphate, zinc phosphate, aluminum phosphate, calcium carbonate, magnesium carbonate, hydroxide calcium, hydroxide magnesium, hydroxide aluminum, calcium methasilicate, calcium sulfate, barium sulfate, bentonite, silica, and alumina. Further, polyvinyl alcohol, gelatine, methyl cellulose, sodium dodecyl benzene sulfonate, adduct of ethylene oxide, and higher alcohol sodium sulfate.

The chain-transfer agent that can be used includes the chain-transfer agents that are commonly employed to adjust the molecular weight of the resin constituting the composite resin particles.

There is no restriction to the type of the chain-transfer agent. It is exemplified by mercaptan such as octylmercaptan, dodecyl mercaptan and tert-dodecyl mercaptan, as well as n-octyl-3-mercapto propionic acid ester, terpinolene, carbon tetrabromide and α-methylstyrene dimer.

The following describes the surface active agent used to prepare the toner that can be used in the present invention:

To perform polymerization using the aforementioned radical polymerizable monomer, a surface active agent must be used to perform oil drop dispersion in the aqueous medium. There is no restriction to the type of the surface active agent that can be used in this case, the following ionic surface active agents can be preferably used.

The ionic surface active agent is exemplified by sulfonate (sodium dodecyl benzene sulfonate, sodium arylalkyl polyether sulfonate, 3,3-disulfone diphenyl urea-4,4-diazo-bis-amino-8-naphthol-6-sodium sulfonate, ortho-carboxy benzene-azo-dimethyl aniline, 2,2,5,5-tetramethyl-triphenylmethane-4,4-diazo-bis-β-naphthol-6-sodium sulfonate, etc.), ester sulfate salt (sodium dodecyl sulfate, sodium tetradesyl sulfate, sodium pentadesyl sulfate, sodium octyl sulfate, etc.), fatty acid salt (sodium oleate, sodium laurate, sodium caprate, sodium caprylate, sodium caproate, and potassium stearate, calcium oleate).

A nonionic surface active agent can also be used. It is exemplified by polyethylene oxide, polypropylene oxide, a combination between polypropylene oxide and polyethylene oxide, ester between polyethylene glycol and higher fatty acid, alkylphenol polyethylene oxide, ester between higher fatty acid and polyethylene glycol, ester between higher fatty acid and polypropylene oxide, and sorbitan ester.

EXAMPLE

The following describes the embodiment of the present invention with reference to examples, without the present invention being restricted thereto.

1. Preparation of Toner (Preparation of Wax Dispersion (1))

680 parts of distilled water, 180 parts of carnauba wax (by Cerarica Noda KK), and 17 parts of sodium dodecyl benzene sulfonate ("Neogen SC" (by Daiichi Kogyo Seiyaku Co., Ltd.) were mixed, and high pressure shearing force was applied to emulsify and disperse the mixture to get a wax particles dispersion. The average diameter of the wax particles was measured by a dynamic light-scattering particle size distribution measuring instrument "ELS-800" (by Otsuka Denshi Kogyo KK). The result was 110 nm.

(Preparation of Wax Dispersion (2))

680 parts of distilled water, 180 parts of pentaerithritol ester ("Unistar H476" (by NOF Corp.), and 17 parts of sodium dodecyl benzene sulfonate ("Neogen SC" (by Daiichi Kogyo Seiyaku Co., Ltd.) were mixed, and high pressure shearing force was applied to emulsify and disperse the mixture to get a wax particles dispersion. The average diameter of the wax particles was measured by a dynamic light-scattering particle size distribution measuring instrument "ELS-800" (by Otsuka Denshi Kogyo KK). The result was 130 nm.

(Preparation of Coloring Agent Particles Dispersion (1))

10 parts of dodecyl benzene sodium sulfonate ("Neogen SC" ((by Daiichi Kogyo Seiyaku Co., Ltd.)) were dissolved in 180 parts of distilled water. 25 parts of carbon black ("Regal 330CR" (by Cabot)) were added to this mixture as coloring agent particles, and were dispersed to prepare the coloring agent particles dispersion (1). The average particle diameter of carbon black in the coloring agent particles dispersion (1) was measured by a dynamic light-scattering particle size distribution measuring instrument "ELS-800" (by Otsuka Denshi Kogyo KK). The result of measurement was 106 nm.

(Preparation of Polymer Primary Particles Dispersion (1))

450 parts of distilled water and 0.56 parts of dodecyl sodium sulfate were added to the reactor equipped with an agitating apparatus, cooling tube and temperature sensor. While this mixture was agitated under the flow of nitrogen gas, the temperature was raised to 80° C. 120 parts of 1 percent by mass of an aqueous solution containing potassium persulfate were added thereto. Then the monomer mixture (1) of the following composition was added for 1.5 hours. After that, it was kept for further two hours, and polymerization was terminated. After termination of polymerization reaction, the mixture was cooled down to the room temperature to obtain the milk white polymer primary particles dispersion (1). The weight average molecular weight of polymer was 11,000. The glass-transition temperature was 34° C. and the softening point was 82° C. The average particle diameter was measured by the dynamic light-scattering particle size distribution measuring instrument "ELS-800" (by Otsuka Denshi Kogyo KK). The result was 120 nm.

<Monomer Mixture (1)>

| | |
|---|---|
| Styrene | 99 parts |
| Butyl acrylate | 52 parts |
| Methacrylate | 14 parts |
| n-octylmercaptan | 6 parts |

(Preparation of Polymer Primary Particles Dispersion (2))

45 parts of wax dispersion (2), 450 parts of distilled water and 0.56 parts of dodecyl sodium sulfate were added to the reactor equipped with an agitating apparatus, cooling tube and temperature sensor. While this mixture was agitated under the flow of nitrogen gas, the temperature was raised to 80° C. 120 parts of 1 percent by mass of an aqueous solution containing potassium persulfate were added thereto. Then the monomer mixture (2) of the following composition was added for 1.5 hours. After that, it was kept for further two hours, and polymerization was terminated. After termination of polymerization reaction, the mixture was cooled down to the room temperature to obtain the milk white polymer primary particles dispersion (2). The weight average molecular weight of polymer was 48,000. The glass-transition temperature was 55° C. and the softening point was 110° C. The average particle diameter was measured by the dynamic light-scattering particle size distribution measuring instrument "ELS-800" (by Otsuka Denshi Kogyo KK). The result was 130 nm.

<Monomer Mixture (2)>

| | |
|---|---|
| Styrene | 120 parts |
| Butyl acrylate | 38 parts |
| Methacrylate | 13 parts |
| n-octylmercaptan | 3 parts |

(Preparation of Polymer Primary Particles Dispersion (3))

450 parts of distilled water and 0.56 parts of dodecyl sodium sulfate were added to the reactor equipped with an agitating apparatus, cooling tube and temperature sensor. While this mixture was agitated under the flow of nitrogen gas, the temperature was raised to 80° C. 120 parts of 1 percent by mass of an aqueous solution containing potassium persulfate were added thereto. Then the monomer mixture (3) of the following composition was added for 1.5 hours. After that, it was kept for further two hours, and polymerization was terminated. After termination of polymerization reaction, the mixture was cooled down to the room temperature to obtain the milk white polymer primary particles dispersion (3). The weight average molecular weight of polymer was 9,800. The glass-transition temperature was 30° C. and the softening point was 78° C. The average particle diameter was measured by the dynamic light-scattering particle size distribution measuring instrument "ELS-800" (by Otsuka Denshi Kogyo KK). The result was 110 nm.

<Monomer mixture (3)>

| | |
|---|---|
| Styrene | 95 parts |
| Butyl acrylate | 58 parts |
| Methacrylate | 12 parts |
| n-octylmercaptan | 8 parts |

(Preparation of Toner 1)

240 parts of polymer primary particles dispersion (1), 13.6 parts of wax dispersive wave (1), 24 parts of coloring agent particles dispersion (1), 5 parts of anionic surface active agent ("Neogen SC" (by Daiichi Kogyo Seiyaku Co., Ltd.) and 240 parts of distilled water were added to the reactor equipped with an agitating apparatus, cooling tube and temperature sensor. While the mixture was agitated, 2 mol/liter of aqueous solution containing hydroxide sodium was added, and the pH value of the mixed dispersion was adjusted to 10.0. 40 parts of 50 percent by mass of aqueous solution containing magnesium chloride were added to this mixture. After that, while the mixture was agitated, the temperature was raised to 80° C. After that, it was kept for further 0.5 hours. Then the temperature was raised to 88° C. After that, it was kept for further 0.5 hours. The toner in the mixed dispersion at this time had an average particle diameter of 4.2 μm.

The temperature in the system was cooled down to 75° C. After that, 20 parts of polymer primary particles dispersion (2) were added and the temperature was raised to 83° C. It was kept for 1.5 hours. After that, 30 parts of polymer primary particles dispersion (2) were added and the temperature was raised to 85° C. After it was kept for 1.5 hours, 120 g of 20 percent by mass of aqueous solution containing sodium chloride were added. The temperature was then raised to 92° C. and was kept for further 1 hour. After that, the mixture was cooled down to the room temperature. A process of cleaning operations such as filtration of the solution and re-suspension of the obtained solid in the distilled water were repeated several times. The mixture was then dried to get toner particles 1 having a volume-based median diameter of 4.6 μm. The glass-transition temperature of the obtained toner particles 1 was 36° C., and the softening point was 84° C.

0.5 parts of hydrophobic silica ("H-2000" (by Clariant), 1.0 parts of titanium oxide ("STT30A" (Titan Kogyo K.K.)) and 1.0 parts of strontium titanate (average particle diameter 0.2 μm) were added to 100 parts of this toner particles. The mixture was mixed by a Henschel mixer (at a peripheral speed of 40 m/sec., 60 sec.) and was processed by a screen having an aperture of 90 μm, whereby toner 1 was obtained.

1. Preparation of Toner 2

Toner 2 was prepared by the same procedure except that the polymer primary particles dispersion (2) instead of the polymer primary particles dispersion (1) was used to prepare the toner 1. The volume-based median diameter of the toner 2 was 4.8 μm. The glass-transition temperature was 32° C. and the softening point was 79° C.

2. Preparation of Toner Cartridge

Eight types of toner cartridges made up of an packaging container having the specifications shown in Table 1, and a storage container of low-density polyethylene containing toner 1 or 2 were prepared. They are shown as Examples 1 through 7, and Comparative Examples 1 through 3.

3. Evaluation Test

The toner cartridge having been manufactured was mounted on the commercially available image forming apparatus BIZHUB PRO 1050™ (by Konica Minolta Co., Ltd.). One thousand sheets were printed per day at 30° C. with a relative humidity of 55% RH for the following evaluation. Printing was provided using a text image with a pixel rate of 7%, a thin line image made up of a plurality of fine lines arranged at an interval of 1.5 mm, and an original image (A4) with each of solid white image and sold black image accounting for a quarter equal part.

<Toner Coagulation>

Image formation by coagulation toner was evaluated by observing the thin line portion of the resolution image in the first and last prints having been outputted at the time of printing 1000 sheets, using a magnifier.

A: Immediately after installation on the image forming apparatus, a roughened structure on the thin line edge was not confirmed until toner in the cartridge was used up.

B: When toner was about to be used up, a slight roughened structure on the thin line edge was observed, but no overlap of thin lines was confirmed.

C: In the intermediate phase during the test, a slight roughened structure was observed on the thin line edge, but no overlap of thin lines was confirmed.

D: Overlap of thin lines occurred due to the roughened structure of the thin line edge, and the presence of a plurality of thin lines cannot be confirmed.

<Toner Spill>

A spill of toner at the time of installation on the image forming apparatus was found out by visual observation.

B: Toner spill was not observed.

D: Toner spill was confirmed. A spotted image defect occurred.

<Missing Transfer>

A test was conducted to evaluate solid black images in the first and last prints having been outputted at the time of printing 1000 sheets, and white spots resulting from missing transfer through observation by a magnifier.

A: Immediately after installation on the image forming apparatus, no white spot was observed in the solid black image or text image until toner in the cartridge was used up.

B: When toner was about to be used up, a slight white spot was observed on the solid black image, but there was no problem according to the visual observation.

C: A white spots was observed on the solid black image in the intermediate phase of test, but there was no problem according to the visual observation.

D: A white spot was confirmed on the solid black image. A white spot was also observed on the text image.

Table 1 shows the results of the test.

TABLE 1

| | Packaging container specifications | | | | Evaluation test | | |
|---|---|---|---|---|---|---|---|
| | Material | Structure | *1 | Toner No. | *2 | Toner spill | Missing transfer |
| Example 1 | Expandable polyethylene | FIG. 1 | 0.10 | 1 | B | B | B |
| Example 2 | Paper-made corrugated fiberboard | FIG. 1 | 0.20 | 2 | B | B | B |
| Example 3 | Paper-made corrugated fiberboard (double) | FIG. 10 | 0.30 | 1 | B | B | B |
| Example 4 | Polyethylene-made fiberboard | FIG. 1 | 0.15 | 1 | A | B | A |
| Example 5 | Polyethylene-made fiberboard | FIG. 10 | 0.15 | 1 | A | B | A |
| Example 6 | Expandable polystyrene | FIG. 10 | 0.08 | 2 | C | B | C |
| Example 7 | Polypropylene-made fiberboard | FIG. 1 | 0.30 | 1 | A | B | A |
| Comparative-Example 1 | Polystyrene-made fiberboard | FIG. 1 | 0.33 | 1 | D | B | C |
| Comparative Example 2 | Air cap | Bag body | 0.04 | 1 | D | D | D |
| Comparative Example 3 | ABS | FIG. 1 | 1.10 | 1 | D | D | D |

*1: Apparent density,
*2: Toner coagulation

As shown in Table 1, in Examples 1 through 7, satisfactory results were obtained for tests on the toner coagulation, toner spill and missing transfer. Especially, better results were obtained when the resin-made packaging container was used than when the paper-made packaging container was used. In the meantime, image errors caused by toner coagulation were observed in all the Comparative Examples 1 through 3.

In the toner cartridge of the above embodiments, the storage container accommodating the toner is packaged in a low-density packaging container having hollow structure to ensure that the stored toner is not affected by outside air. Thus, even if the toner cartridge for storing the toner containing low-temperature fixing property is not conveyed by a low-temperature trucking vehicle, toner is not damaged by heat. Further, the cartridge together with the packaging container can be mounted on the image forming apparatus. Even when the toner of low-temperature fixing property is used in the image forming apparatus installed in the high-temperature environment, stable image formation can be ensured, without the toner being affected by such installation environment as dew condensation.

The cartridge of the aforesaid embodiments equipped with an packaging container is mounted on an image forming apparatus. After use, the cartridge together with the packaging container can be collected for recycling. Thus, use of this toner cartridge does not involve such a problem of generation of waste or loss of an packaging container during the use with the image forming apparatus. Thus, the present invention provides an environment-friendly toner cartridge compatible with low-temperature fixing, wherein the burden resulting from storage of the packaging container is not imposed on a user.

In the aforesaid embodiments, the cartridge together with an packaging container is mounted on an image forming apparatus. Thus, the present invention provides a user-friendly toner cartridge of enhanced usability which saves the user's time and effort of packaging a contaminated container again in the packaging container at the time of mounting the cartridge, or taking out the storage container for accommodating the toner from the packaging container.

What is claimed is:

1. An image forming method using an electrophotographic method utilizing toner, comprising steps of:

mounting a toner cartridge having a packaging container and a storage container storing the toner, on an image forming apparatus, wherein the toner is supplied through a toner supply section of the storage container to a toner replenishment section of the image forming apparatus and the storage container is accommodated in the packaging container, and the packaging container is formed of a member having a hollow structure with an apparent density of 0.1 through 0.3; and forming an image through the electrophotographic process utilizing the toner from the toner cartridge which is mounted on the image forming apparatus, wherein the toner contains a resin having a glass-transition temperature of 0° C. through 46° C. and a softening point of 75° C. through 110° C., and having a volume-based median diameter (D50) of 3.5 μm through 8.5 μm, supplied from the storage container.

2. The image forming method of claim 1, wherein the packaging container and storage container are formed by a material having transparency that allows an amount of remaining toner to be identified from outside.

3. The image forming method of claim 2, wherein the storing container is formed of a flexible bag.

4. The image forming method of claim 3, wherein the packaging container has a window having transparency that allows an amount of remaining toner to be identified from outside.

5. The image forming method of claim 4, wherein the packaging container is formed by a corrugated plastic board having transparency that allows an amount of remaining toner to be identified from outside.

6. The image forming method of claim 1, wherein the packaging container has a window having transparency that allows an amount of remaining toner to be identified from outside.

7. The image forming method of claim 1, wherein the packaging container is formed by a corrugated plastic board having transparency that allows an amount of remaining toner to be identified from outside.

8. The image forming method of claim 1, wherein the storing container is formed of a flexible bag.

9. An image forming apparatus using an electrophotographic process utilizing toner, comprising:

a toner cartridge having a storage container and a packaging container, the storage container storing toner that contains a resin having a glass transition temperature of 0° C. through 46° C. and a softening point of 75° C. through 110° C., and having a volume-based median diameter (D50) of 3.5 μm through 8.5 μm;

the packaging container formed by a member having a hollow structure with an apparent density of 0.1 through 0.3 to accommodate the storage container; and a toner supply section to supply the toner to the image forming apparatus by exposing the toner supply section through an opening provided on the packaging container;

wherein the toner cartridge is mounted on the image forming apparatus in such a state that the storage section is accommodated in the packaging container during the electrophotographic process of the image forming apparatus while supplying toner to the image forming apparatus.

10. The image forming apparatus of claim 9, wherein the storing container is formed of a flexible bag.

11. The image forming apparatus of claim 10, wherein the packaging container and the storage container are formed by a material having transparency that allows an amount of remaining toner to be identified from outside.

12. The image forming apparatus of claim 11, wherein the packaging container has a window having transparency that allows an amount of remaining toner to be identified from outside.

13. The image forming apparatus of claim 12, wherein the packaging container is formed by a corrugated plastic board having transparency that allows an amount of remaining toner to be identified from outside.

14. The image forming apparatus of claim 9, wherein the packaging container and the storage container are formed by a material having transparency that allows an amount of remaining toner to be identified from outside.

15. The image forming apparatus of claim 9, wherein the packaging container has a window having transparency that allows an amount of remaining toner to be identified from outside.

16. The image forming apparatus of claim 15, wherein the packaging container is formed by a corrugated plastic board having transparency that allows an amount of remaining toner to be identified from outside.

17. The image forming method of claim 1, further comprising a step of exposing the toner supply section of the storage container through an opening section provided on the packaging container to supply the toner.

* * * * *